US008740749B2

(12) United States Patent
Tsarpela

(10) Patent No.: US 8,740,749 B2
(45) Date of Patent: Jun. 3, 2014

(54) GYM EQUIPMENT OR MACHINE FOR IMPROVED MECHANICAL NEUROMUSCULAR STIMULATION

(76) Inventor: Olga Tsarpela, Rome (IT)

( * ) Notice: Subject to any disclaimer, the term of this patent is extended or adjusted under 35 U.S.C. 154(b) by 2106 days.

(21) Appl. No.: 12/991,313

(22) PCT Filed: Dec. 22, 2005

(86) PCT No.: PCT/IT2005/000759
§ 371 (c)(1),
(2), (4) Date: Nov. 5, 2010

(87) PCT Pub. No.: WO2006/070429
PCT Pub. Date: Jul. 6, 2006

(65) Prior Publication Data

US 2012/0142496 A1 Jun. 7, 2012

(30) Foreign Application Priority Data

Dec. 27, 2004 (IT) ..... RM2004A0640

(51) Int. Cl.
*A63B 24/00* (2006.01)

(52) U.S. Cl.
USPC ..... 482/1; 482/8; 482/148

(58) Field of Classification Search
USPC ..... 482/1–9, 51, 54, 110, 900–902
See application file for complete search history.

(56) References Cited

U.S. PATENT DOCUMENTS

| | | | | |
|---|---|---|---|---|
| 850,938 | A | 4/1907 | Kellogg | |
| 1,013,782 | A | 1/1912 | Koch | |
| 2,349,743 | A | 5/1944 | Meyer | |
| 5,868,653 | A * | 2/1999 | Klasen | 482/110 |
| 7,238,143 | B1 * | 7/2007 | Sokolovos et al. | 482/1 |
| 2001/0000782 | A1 | 5/2001 | Schiessl | |
| 2003/0225348 | A1 | 12/2003 | Chen | |
| 2004/0067833 | A1 | 4/2004 | Talish | |
| 2008/0207407 | A1 * | 8/2008 | Yeh | 482/54 |

FOREIGN PATENT DOCUMENTS

| | | | |
|---|---|---|---|
| JP | 9-201429 | A | 8/1997 |
| SU | 1447385 | A1 | 12/1988 |
| WO | 01-56650 | A1 | 8/2001 |
| WO | 2004-103484 | A1 | 12/2004 |

OTHER PUBLICATIONS

International Search Report, PCT/IT2005/000759, Apr. 20, 2006.

* cited by examiner

*Primary Examiner* — Glenn Richman
(74) *Attorney, Agent, or Firm* — Hershkovitz & Associates, PLLC; Abraham Hershkovitz

(57) ABSTRACT

The invention concerns an apparatus (1, 10, 20, 30, 40, 50, 60, 70, 80, 90, 100, 110, 120, 130, 140) for physical exercises, comprising at least one element (2, 4, 4', 23, 23', 34, 34', 55, 55', 57, 57', 65, 65', 67, 75, 76, 80, 96, 96', 105, 105', 112, 114, 114', 124, 124', 125, 126, 133, 134, 137, 141, 141') capable to interact with a user during the execution of a physical exercise, characterising in that it comprises vibrating means (5, 6, 11, 12, 78, 85, 97, 106, 116, 116', 117) capable to produce at least one mechanical vibration of said at least one element.

35 Claims, 16 Drawing Sheets

GYM EQUIPMENT OR MACHINE FOR IMPROVED MECHANICAL NEUROMUSCULAR STIMULATION

CROSS-REFERENCE TO RELATED APPLICATIONS

Figure 1:
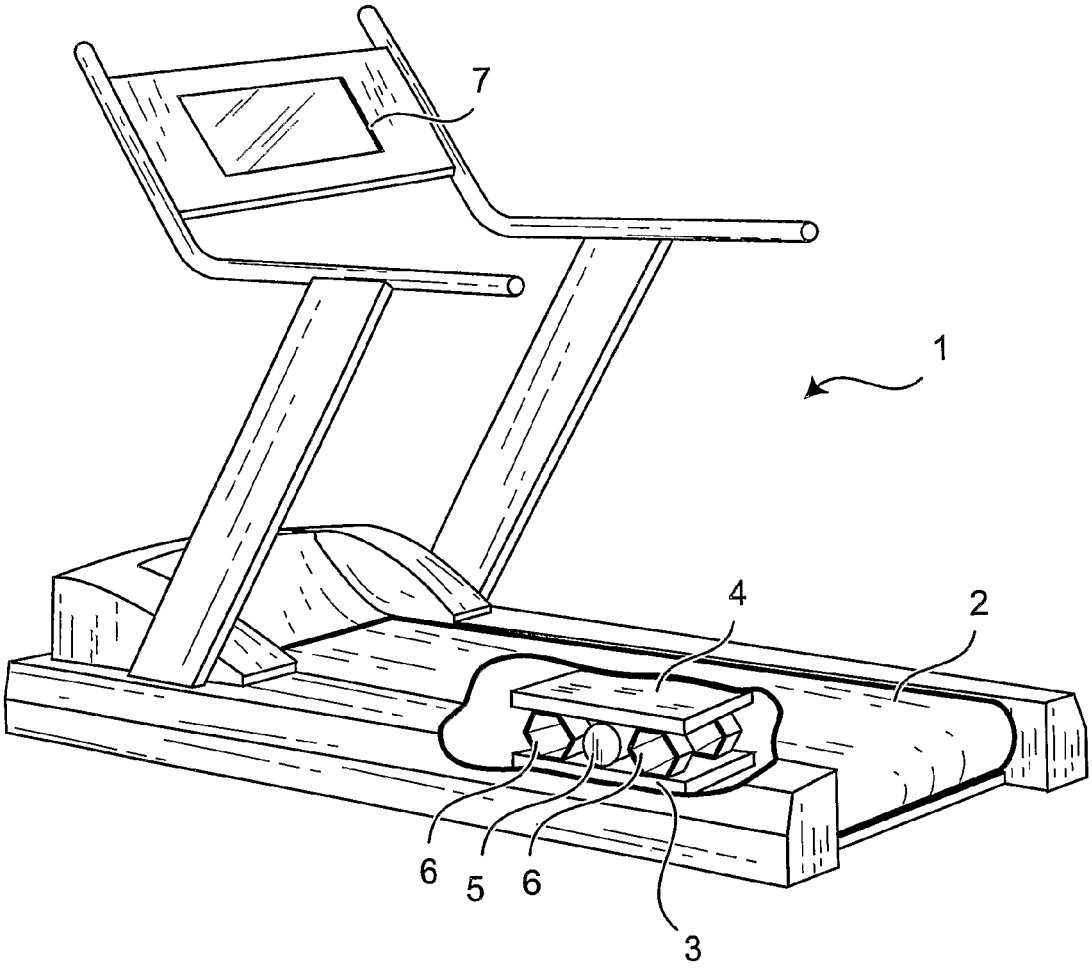

The present Application is a US national phase of PCT/IT2005/000759 filed on Dec. 22, 2005 ("PCT Application"), which claims priority from Italian Application No. RM2004A000640 filed on Dec. 27, 2004, both of which are hereby incorporated by reference in their entirety into the present Application. Any amendments made in the PCT Application during the international phase are also incorporated herein by reference.

The present invention relates to an apparatus for physical exercise, to be meant in the following as both gym equipment and gym machine, for improved mechanical neuromuscular stimulation produced by means of mechanical vibrations having a preferably constant frequency, preferably applied to at least one limb of a user, that allows in a simple way the execution of normal gym exercises, equipment or the machine being highly reliable and effective. Furthermore, the apparatus for physical exercise may further provides a preliminary detection of the frequency of the periodical contractions of a muscle of the user, due to mechanical vibrations of at least one element of the apparatus, that corresponds to the best electromyographycal response for the detected muscle, and a successive stimulation thereof at the detected optimal frequency.

In the following of the description, the term "apparatus for physical exercise", to be meant as both gym equipment and gym machine, and the terms "gym equipment" and "gym machine", for indicating specific implementations of the apparatus for physical exercise, will be indifferently used.

It is known that when a muscle is stimulated by application of mechanical vibrations, it contracts in a reflex way very similarly to what happens when the muscle is operated by voluntary contractions, e.g. during the execution of physical works.

In particular, varying the frequency of the mechanical vibrations, it is possible to make selectively working fast or slow muscular fibres.

Recently, many gym machines for mechanical muscular stimulation have been made, which substantially comprise a board for the leg muscles, or a vibrator for the arm muscles.

Such machines are useful for exercising, since they allow to obtain results similar to those of the standard physical exercises within the gymnasium in a shorter time, for attaining a good muscular tone by few application minutes, and for physiotherapic uses aimed to the maintenance of the muscular tone or to the functional recover of the muscles, for example during or after immobilisation periods due to fractures or surgical interventions.

However, present muscular stimulation machines present some drawbacks.

The main drawback is represented by the fact that the they do not allow a stimulation of the muscles while performing gym exercises, such as for instance, running or weight-lifting.

Moreover, mechanical vibration frequency, that can be manually set, is not optimised for both the specific fibres of a determined muscle of the specific user and the whole body.

In fact, as disclosed in the International PCT Application No. WO 01/56650, the specific fibres of each muscle of any single user have a response to the micromechanical vibrations that is variable while the frequency of the applied vibration varies. In particular, it can be individuated a frequency range, which can be defined "activity range", within which specific fibres of the particular muscle respond to the stimulations and, within said range, it can be determined an optimum mechanical vibration frequency in correspondence of which said response is the maximum one. In the case when the set frequency is different from the optimum one, the work of the interested muscle is not efficient for its toning up and, in the case when the set frequency is not included within the activity range, the muscular work is completely null. In some cases, the wrong setting of the vibration frequency could even produce harmful results.

Similar drawbacks are present in muscle electrical stimulation devices, wherein, on one hand, the execution of gym exercises is uncomfortable and impracticable, and, on the other hand, the frequency of the electrical signal applied to the specific muscle is not optimised It is therefore an object of the present invention to provide a highly reliable and effective gym machine, that allows in a simple way to exert by means of mechanical vibrations at least one muscle, preferably a muscle of a limb, of a user, which have a frequency, during the execution of gym exercises by the user.

It is another object of the present invention to provide such a machine that is capable to determine in an automatic way the optimum periodic stimulated contraction frequency at which the specific fibres of the particular interested muscle have the maximum, not only muscular, but also generally speaking biological, response.

It is still an object of the present invention to provide such a machine for the neuromuscular stimulation, capable to automatically determine the optimum frequency of the mechanical vibration to be applied to the particular interested muscle so as to stimulate periodic contractions at optimum frequency It is specific subject matter of the present invention an apparatus for physical exercises, comprising at least one element, capable to interact with a user during the execution of a physical exercise, characterising in that it comprises vibrating means capable to produce at least one mechanical vibration of said at least one element.

Always according to the invention, said at least one mechanical vibration may occur at a frequency included within an interval ranging from a lower limit frequency, preferably equal to 20 Hz, to an upper limit frequency, preferably equal to 55 Hz.

Still according to the invention, said vibrating means may comprise at least one vibrating electric motor coupled to said at least one element.

Furthermore according to the invention, said at least one vibrating electric motor may be an eccentric mass motor.

Always according to the invention, said at least one vibrating electric motor may be capable to produce at least one vibration of amplitude ranging from 1 to 10 mm, preferably from 2 to 5 mm.

Still according to the invention, said at least one element may comprise at least one first platform to which said at least one vibrating electric motor is coupled.

Furthermore according to the invention, said at least one element may further comprise at least one handle integrally coupled to said at least one first platform.

Always according to the invention, the apparatus may further comprise at least one second platform, and vibration-damping means may be located between said at least one second platform and said at least one first platform, capable to oppose the vibration produced by said vibrating means.

Still according to the invention, said at least one element may comprise at least one rod to which said at least one vibrating electric motor is coupled.

Furthermore according to the invention, the apparatus may further comprise vibration-damping means capable to oppose the vibration produced by said vibrating means.

Always according to the invention, said vibration-damping means may comprise one or more components in natural or synthetic rubber, preferably neoprene.

Still according to the invention, at least one of said one or more components may have substantially hexagonal shape.

Furthermore according to the invention, said at least one element may comprise at least one cable, provided with at least one component capable to be clung by the user, and said vibrating means comprises at least one cam device into which said at least one cable is capable to slide.

Always according to the invention, said at least one device may be capable to be operated by an electric motor.

Still according to the invention, said at least one said at least one component, capable to be clung by the user, may comprise a handle and/or a rod.

Furthermore according to the invention, said at least one element may be capable to be connected to one or more selectable weights for adjusting its load.

Always according to the invention, the apparatus may be:

a machine for running or "treadmill", said at least one element comprising at least one mat capable to rotate around to said at least one first platform; and/or a machine for simulating steps or "step" machine, comprising a first right platform and a first left platform, capable to vertically move in a reciprocally constrained way through a pivoted lever; and/or an elliptical machine, comprising a first right platform and a first left platform, capable to move in a reciprocally constrained way by means of two respective motion transmission levers, in turn connected to at least two respective cams, preferably further comprising two rods operating as front levers, the movement of which is synchronised with that of the first right and left platforms by means of a connection to said at least two cams; and/or a machine for exercising the leg muscles or "leg press", comprising at least one first platform, a seat, and mechanical means capable to allow said at least one first platform and the seat to reciprocally move with respect to one another, so that said mechanical means elastically opposes to their reciprocal moving apart, preferably further comprising two rods operating as side levers for supporting the user; and/or a machine for exercising the calf muscles, also called "calf machine", comprising at least one first base platform; and/or a machine for exercising the pectoral and dorsal muscles, comprising two rods operating as pair of side right and left levers, the machine further comprising mechanical means capable to allow each one of the side right and left levers to rotate, so that said mechanical means elastically opposes to the moving of the side levers away from an angular rest position; and/or a machine for exercising the triceps or "triceps press", comprising two rods operating as pair of side right and left levers, the machine further comprising mechanical means capable to allow each one of the side right and left levers to rotate, so that said mechanical means elastically opposes to the moving of the side levers away from an angular rest position; and/or a machine for tractions at the bar or "lat machine", comprising an upper rod; and/or a barbell; and/or a machine for stretching legs or "leg extension", comprising a seat and a rod operating as front lever rotatably coupled to the seat so as to be capable to rotate upwards; and/or a machine for contracting legs or "leg curl", comprising a bench and a rod operating as front lever rotatably coupled to the bench so as to be capable to rotate upwards; and/or a machine for contracting legs in an upright position or "standing gluteus" machine; and/or a cable traction machine for exercising the muscles of the limbs, comprising at least one cable; and/or a machine for simulating rowing or "rower", comprising at least one first platform, a seat, and mechanical means capable to allow said at least one first platform and the seat to reciprocally move with respect to one another, the machine further comprising a rod capable to pull a cable capable to elastically oppose to its pull, wherein said cable preferably slides in a cam device; and/or an exercise cycle, comprising a frame, a right pedal and a left pedal being coupled to the shaft of a rotary disc, a flywheel connected to the rotary disc by means of belt drive means opposing the rotation of the pedals, the exercise cycle further comprising at least one first platform to which the shaft of the rotary disc is coupled, tightener means interacting with said belt drive means; and/or a pommel horse, comprising two handles or pommels integrally coupled to at least one first platform.

Still according to the invention, the apparatus may further comprise interface electronic means capable to set the operation of said vibrating means.

Furthermore according to the invention, the apparatus may comprise controlling electronic means capable to control the operation of said vibrating means, said controlling electronic means being capable to be connected to one or more muscular electrical activity sensors, each applied to a corresponding user's muscle, said controlling electronic means managing and controlling said vibrating means, by processing data coming from the sensors so as to determine, within an interval ranging from a lower limit lower limit frequency to an upper limit frequency, an optimal frequency of said at least one vibration in correspondence of which the sum of the amplitudes of the signals given to the sensors by the corresponding user's muscles is maximum, said controlling electronic means setting the operation of said vibrating means so as to produce said at least one vibration at the determined optimal frequency.

Preferably according to the invention, the lower limit frequency is equal to 1 Hz, and/or the upper limit frequency is equal to 1000 Hz.

Always according to the invention, at least one of said one or more sensors may comprise medical electrodes, amplified in situ, an insulating amplifier and a signal converter outputting a digital signal that is read by said controlling electronic means.

Still according to the invention, said controlling electronic means may perform a method for determining the optimal frequency comprising the following steps:

a step of applying said one or more sensors to corresponding muscles;

repeating for a number N of times, preferably equal to eight, a step of acquiring data wherein said controlling electronic means activates said vibrating means so as to produce said at least one vibration at constant frequency for a time $\Delta t$, preferably ranging from 5 and 10 seconds, with progressively growing frequency, from a repetition to the following one, ranging from the lower limit frequency to the upper limit frequency, it processes, for each repetition, the average of the amplitude of the signals coming from the sensors, and it stores it into a storage unit along with the value of the corresponding vibration frequency; and a step of determining the maximum sum of the averages of the amplitude of the signals sensed by the sensors, wherein said controlling electronic means determines, among the stored ones, the sum of the averages at the same frequency having maximum value, determining the optimal frequency.

Furthermore according to the invention, the frequencies of consecutive repetitions may have a constant difference from each other.

Always according to the invention, the frequencies of consecutive repetitions may have a variable and increasing difference depending on the absolute value of the frequency of the preceding repetition.

Still according to the invention, said controlling electronic means may perform a method for determining the optimal frequency comprising the following steps:

a step of applying said one or more sensors to corresponding muscles;

iterating by a number M of times, preferably equal to two, loops of a number $N_i$ of repetitions, where i indicates the i-th iteration, of steps of acquiring data wherein said controlling electronic means activates said vibrating means so as to produce said at least one vibration at constant frequency for a time $\Delta t$, preferably ranging from 5 and 10 seconds, with progressively growing frequency, from a repetition to the following one, ranging from a first lower frequency and a second upper frequency, the frequencies of consecutive repetitions having a constant difference $\Delta f_i$ from each other, said controlling electronic means calculating, for each repetition, the average of the amplitude of the signals coming from said one or more sensors and storing the same in a storage unit along with the value of the corresponding frequency, said controlling electronic means determining for each iteration i, the maximum sum of the averages of the amplitude of the sensed signals and determining the corresponding best frequency, at each iteration i, next to the first one, the interval between the first lower frequency and the second upper frequency comprising the best frequency determined in the preceding iteration, at each iteration i, next to the first one, the constant difference $\Delta f_i$ between the frequencies of consecutive repetition being lower than the difference $\Delta f_{i-1}$ of the preceding iteration ($\Delta f_i < \Delta f_{i-1}$); and a step of determining the optimal frequency, at the end of the M-th iteration, in which the best frequency determined in the M-th iteration is stored as the optimal frequency.

Furthermore according to the invention, for the first iteration, the first lower frequency may coincide with the lower limit frequency and/or the second upper frequency coincides with the upper limit frequency.

Always according to the invention, at each iteration i, next to the first one, the interval between the first lower frequency and the second upper frequency may comprise the best frequency determined in the preceding iteration as intermediate frequency.

It is also specific subject matter of the present invention a device comprising vibrating means, capable to produce at least one mechanical vibration of at least one element, said element is capable to interact with a user during the execution of a physical exercise, and in that it comprises coupling mechanical means so as to be retrofit applicable to an apparatus for physical exercises.

Figure 2:
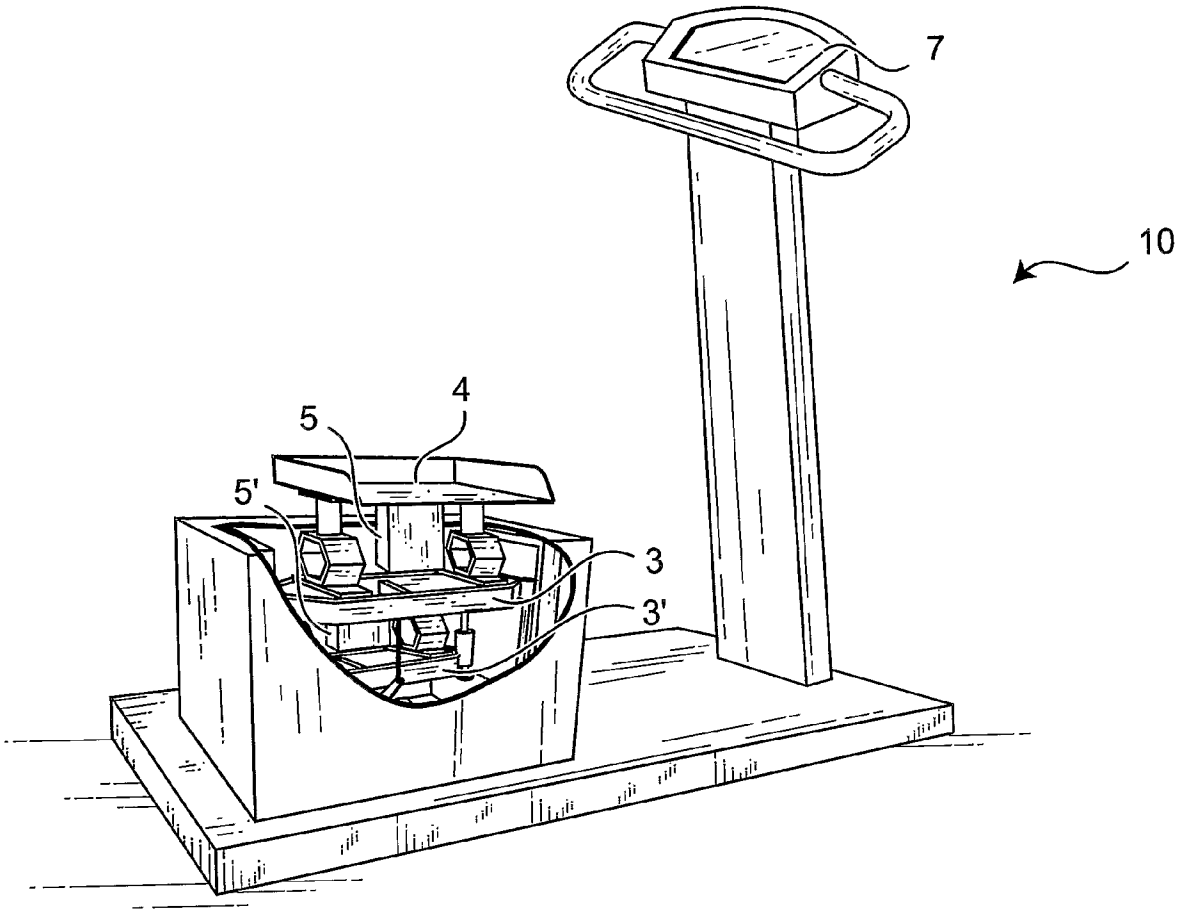
Figure 3:
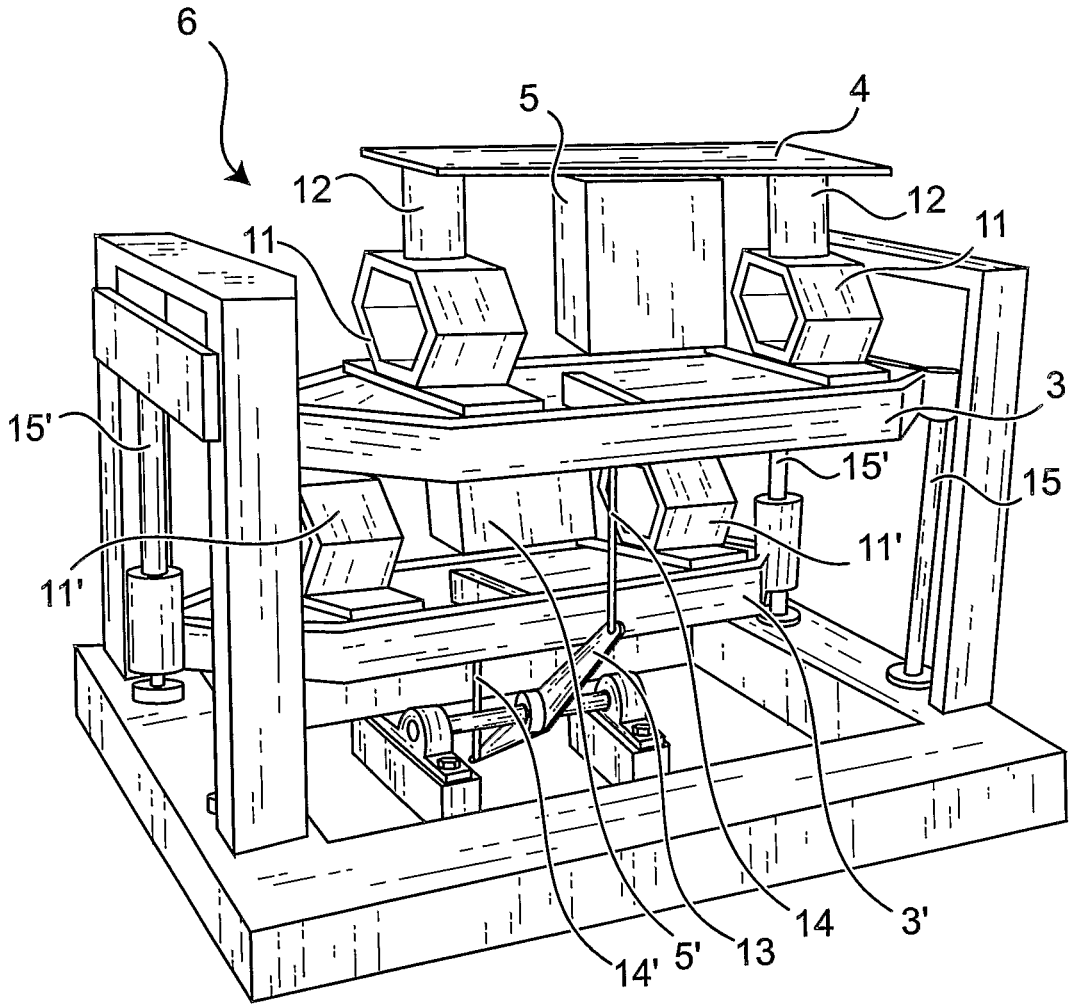
Figure 4:
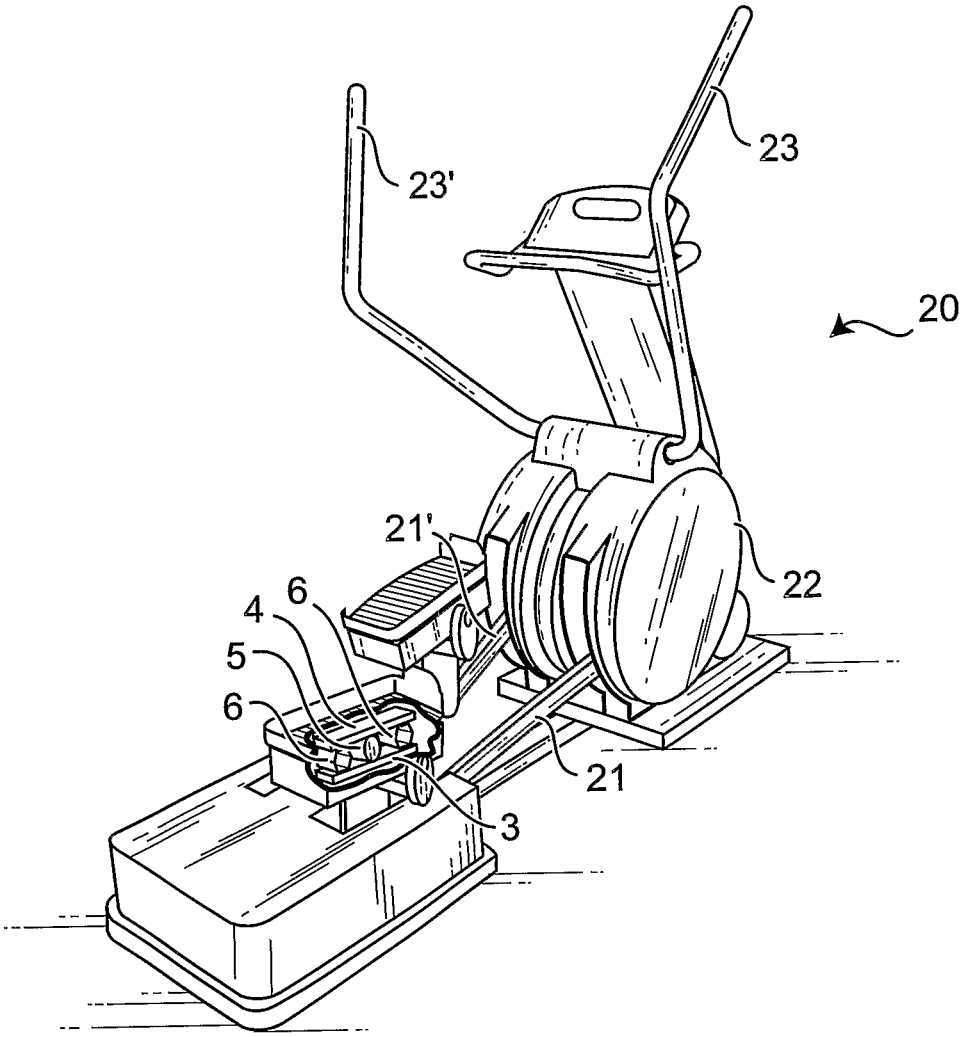
Figure 5:
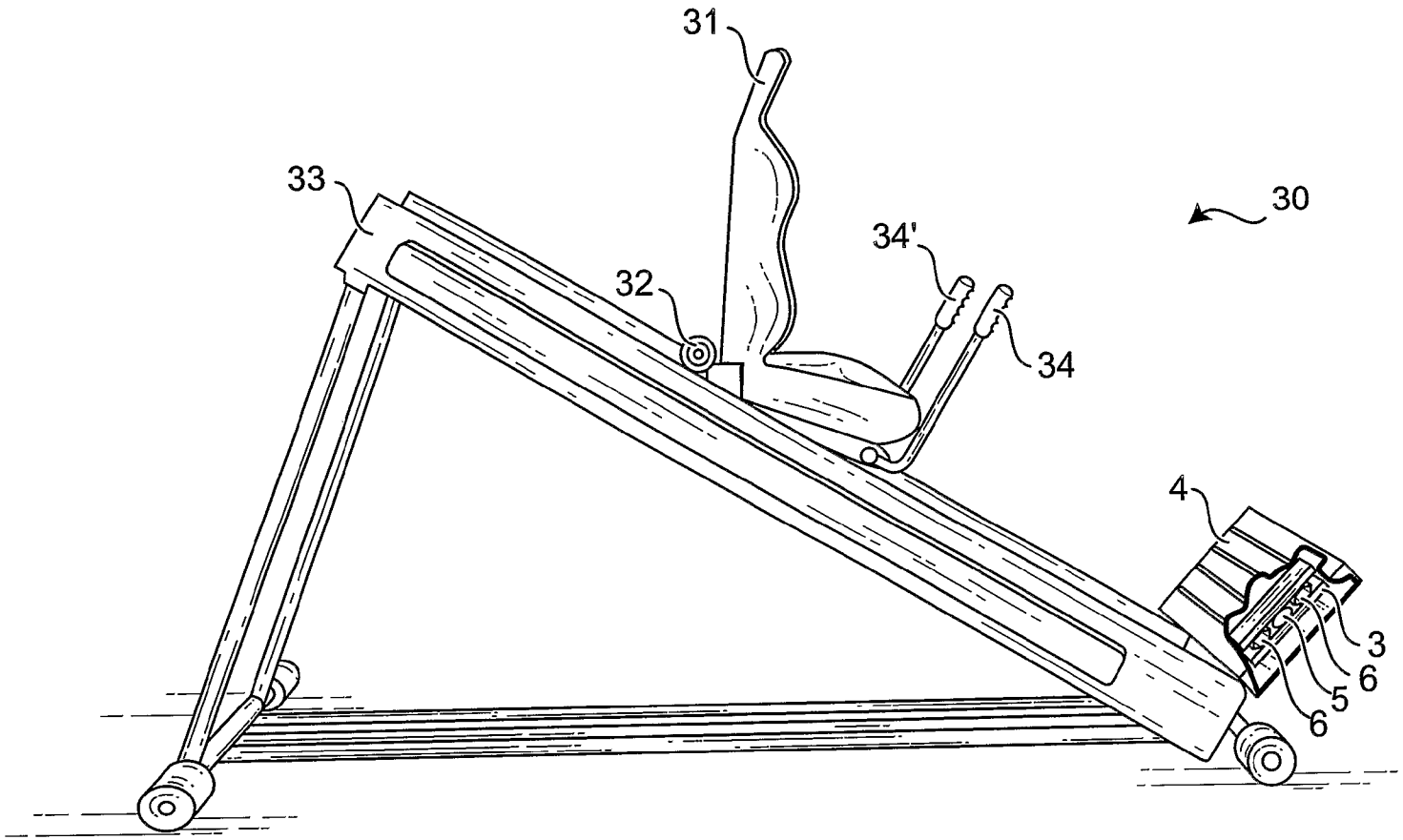
Figure 6:
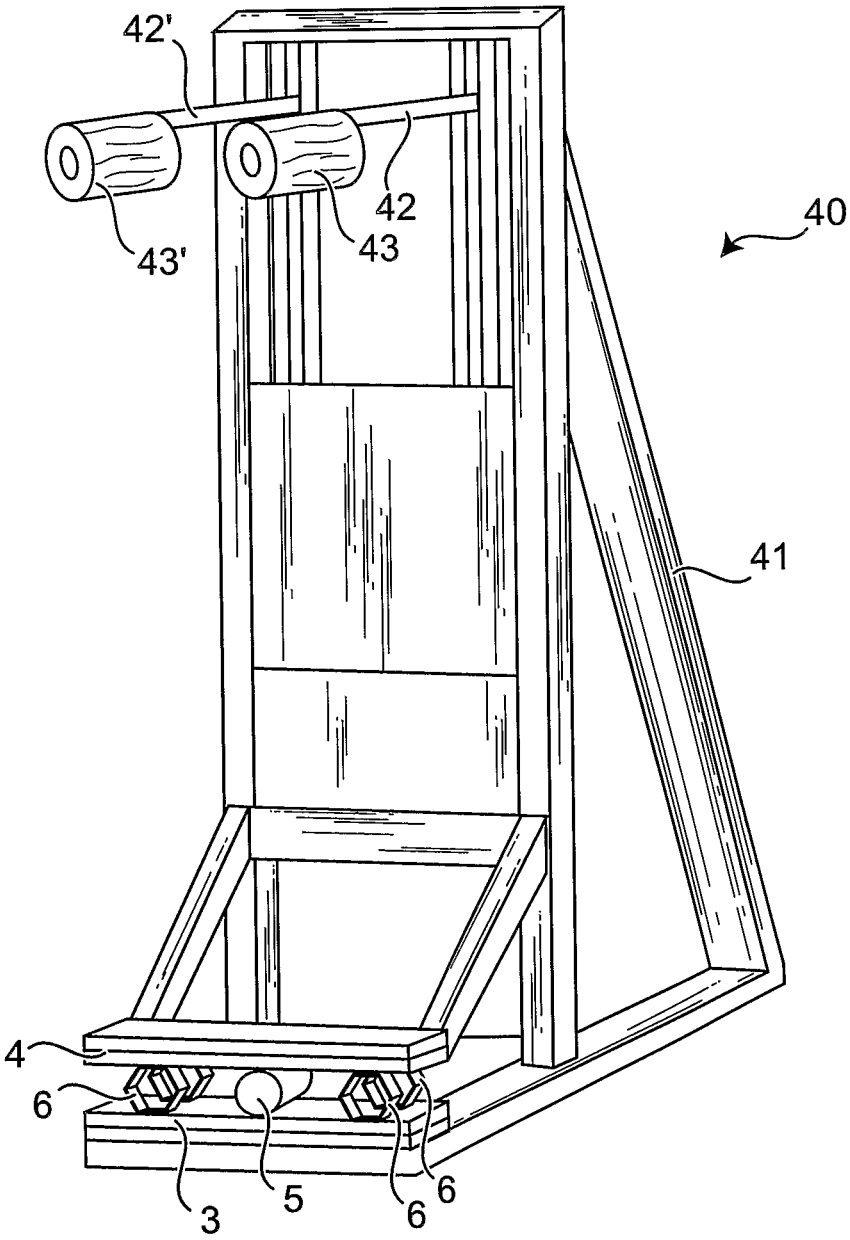
Figure 7:
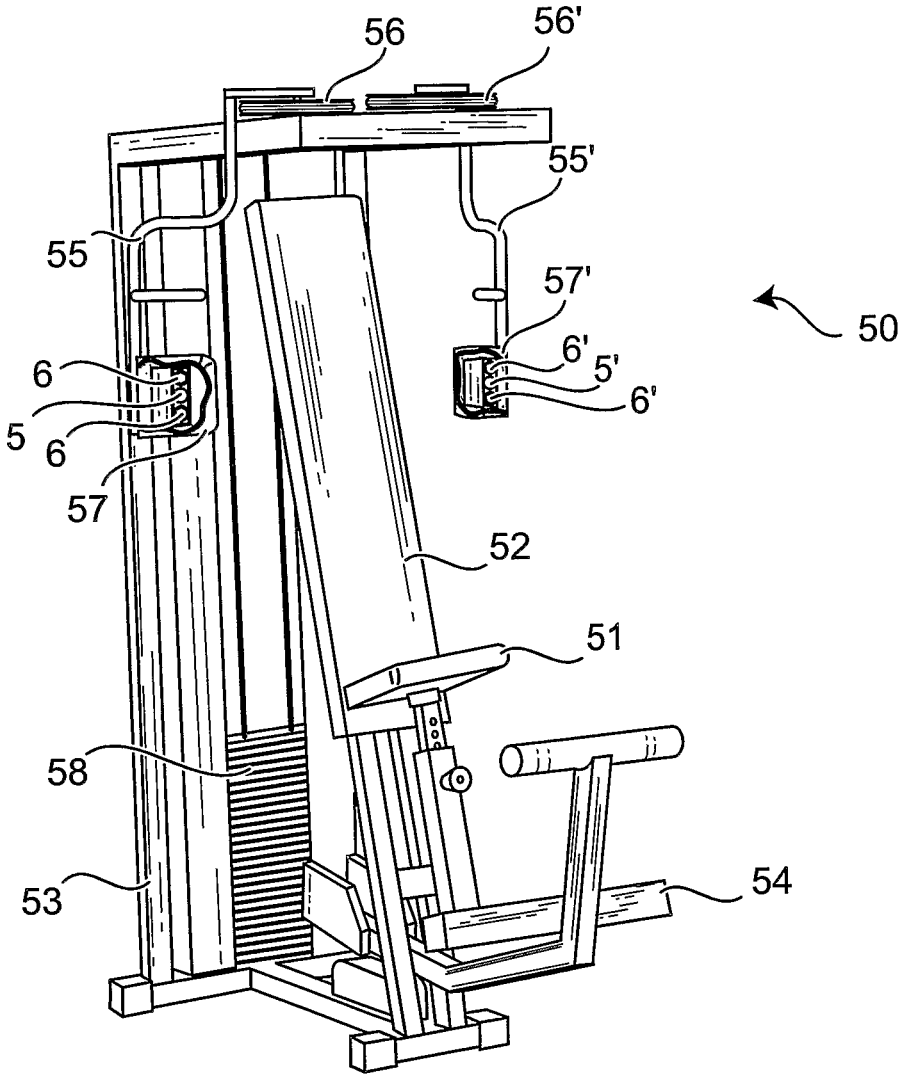
Figure 8:
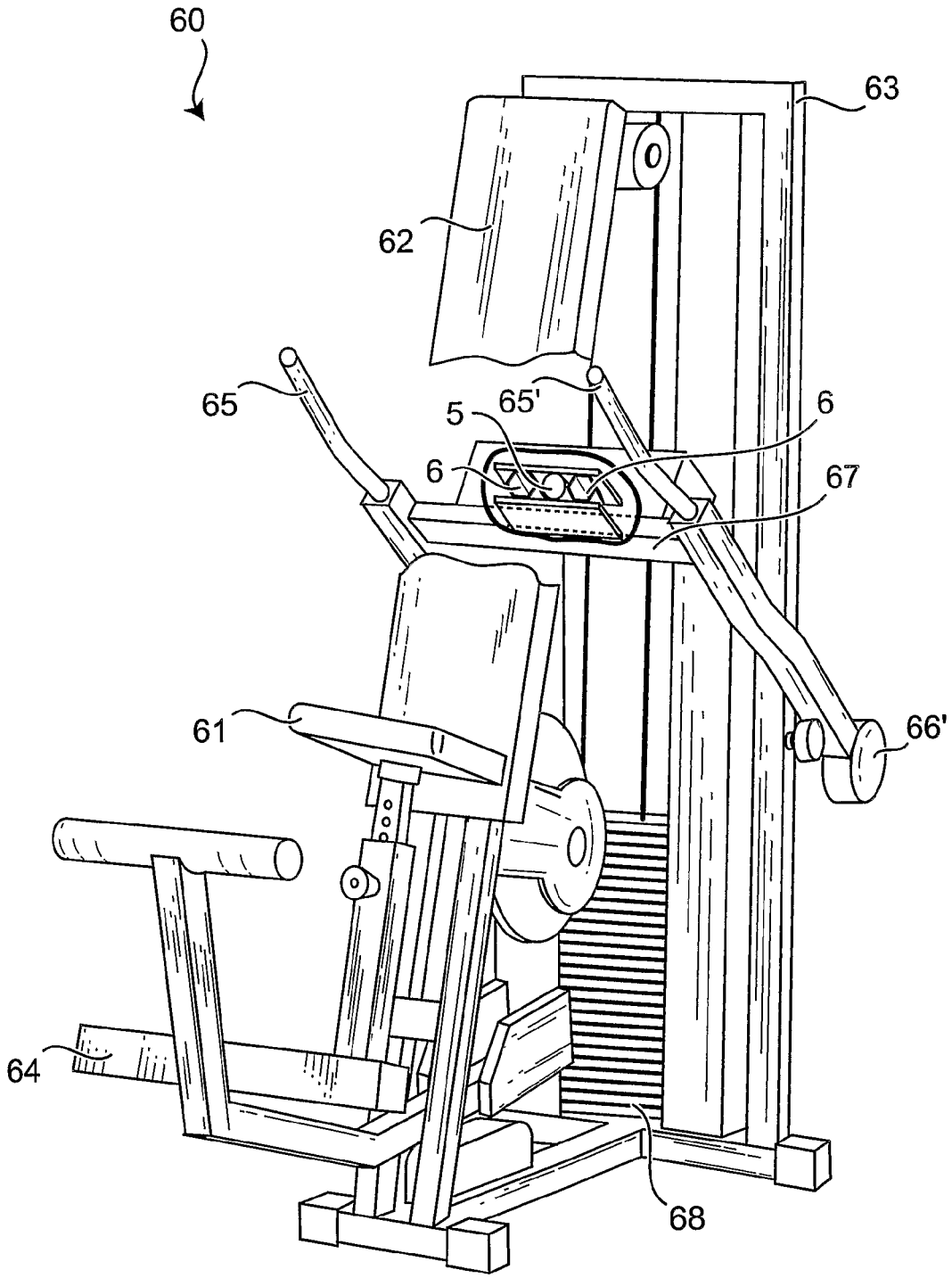
Figure 9:
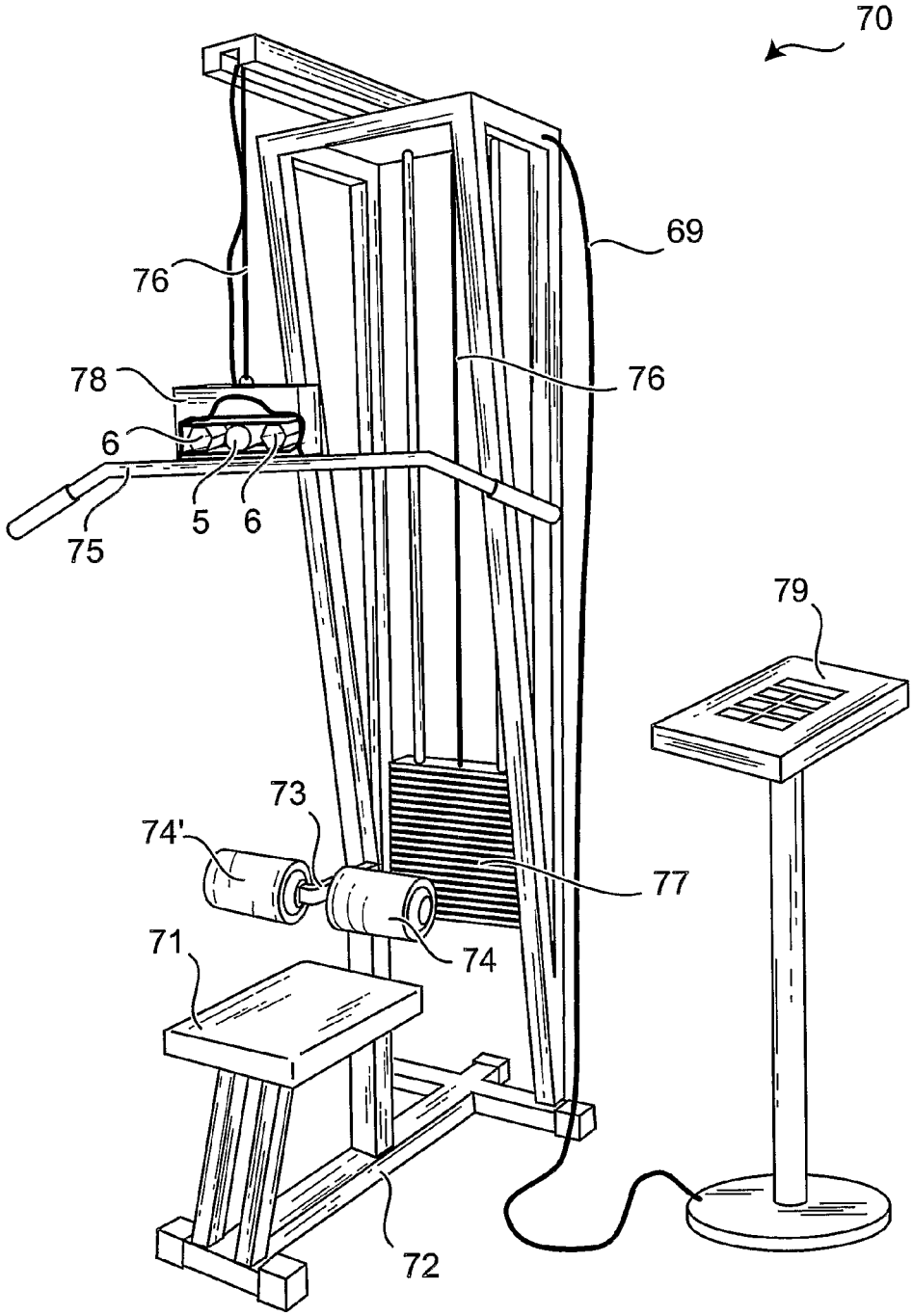
Figure 10:
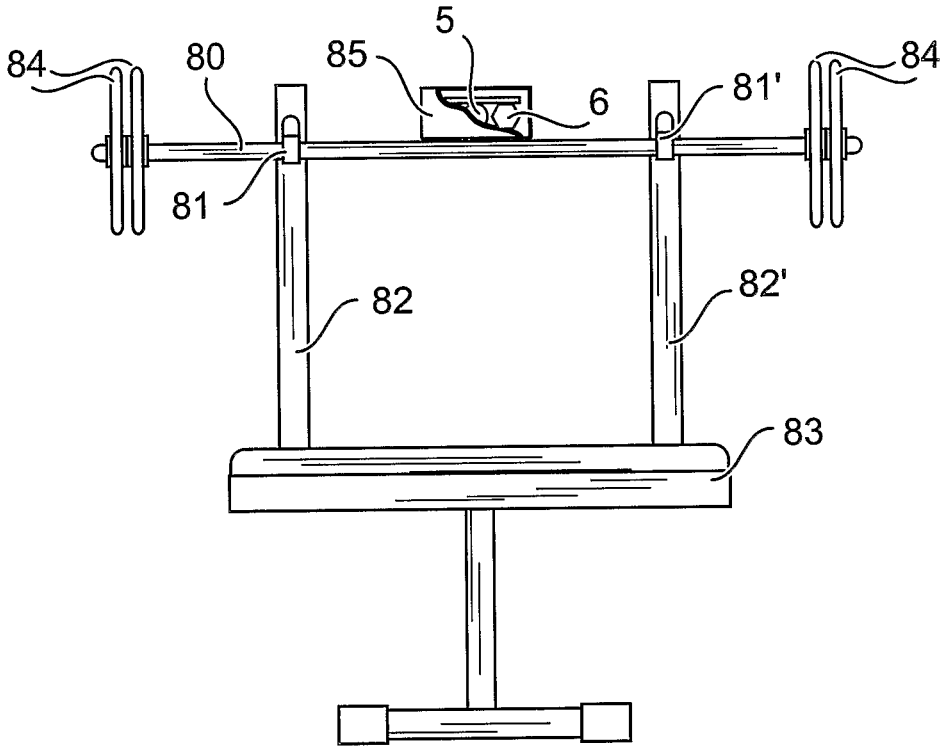
Figure 11:
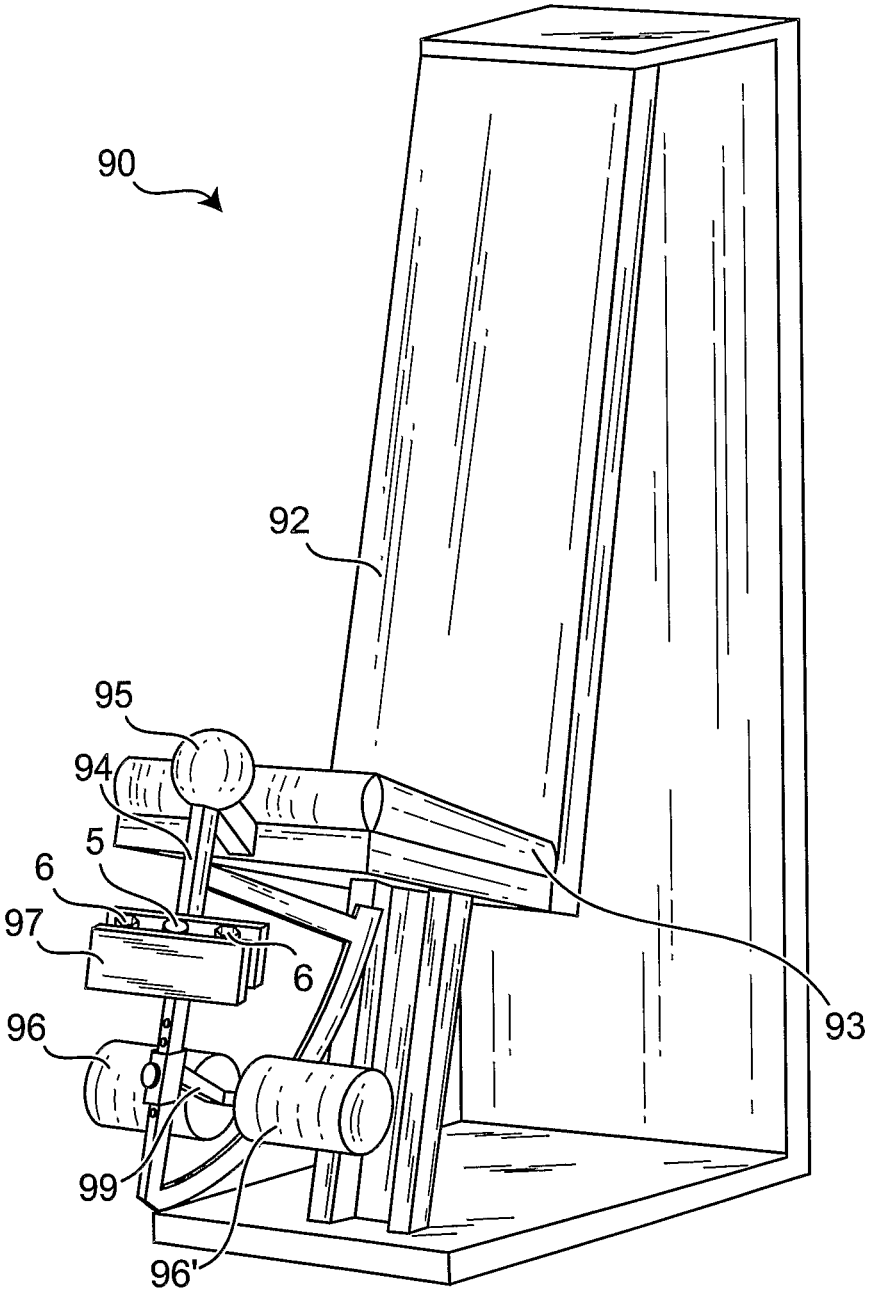
Figure 12:
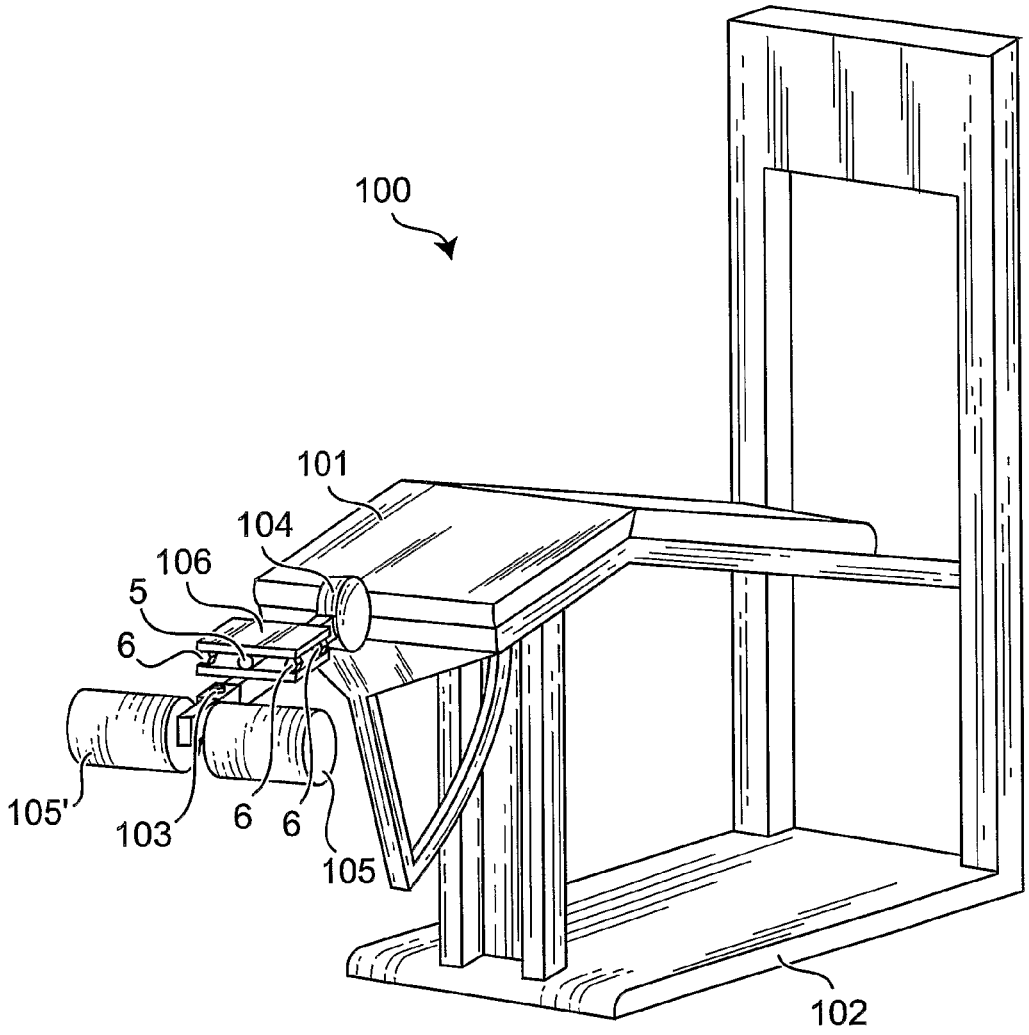
Figure 13:
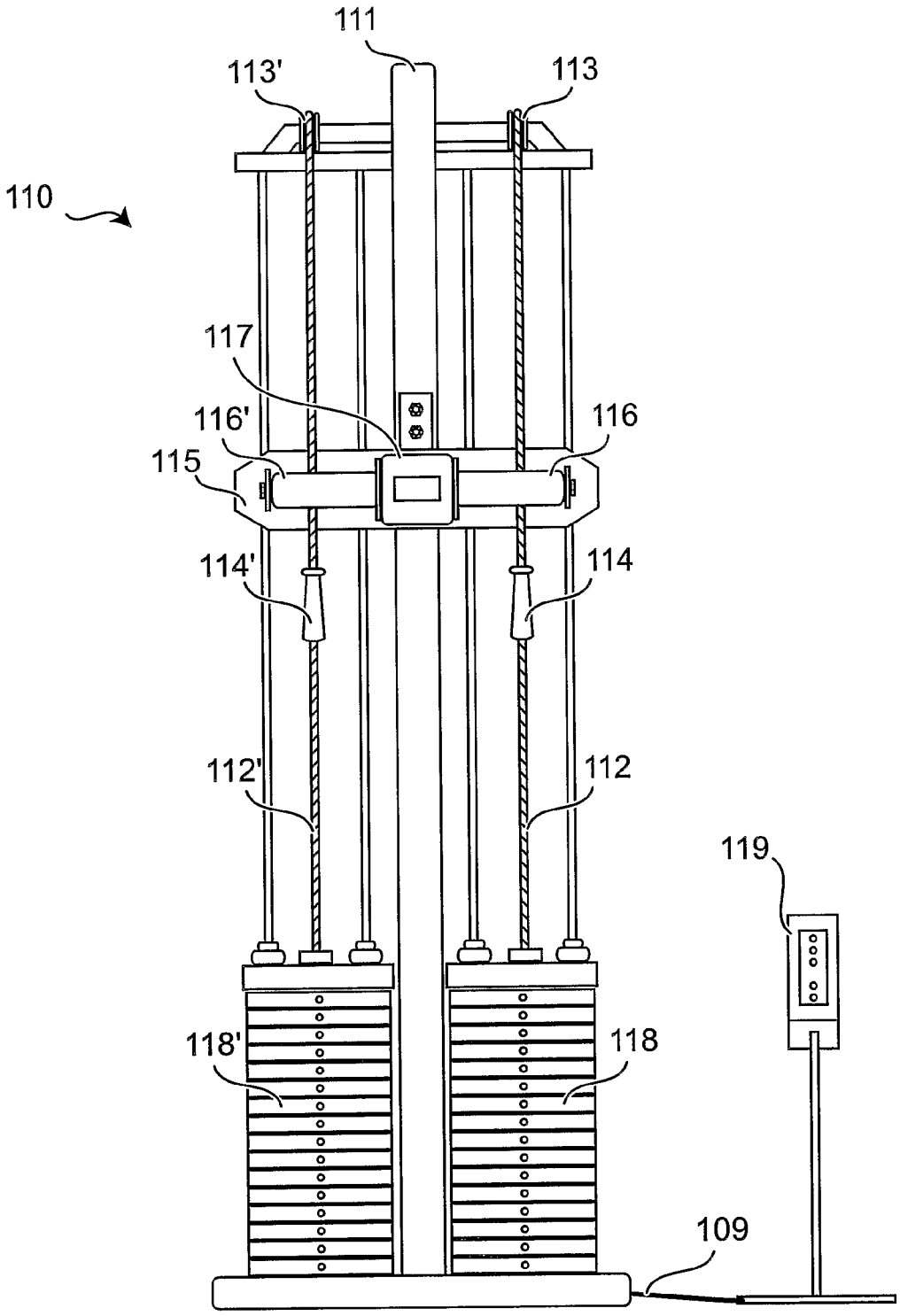
Figure 14:
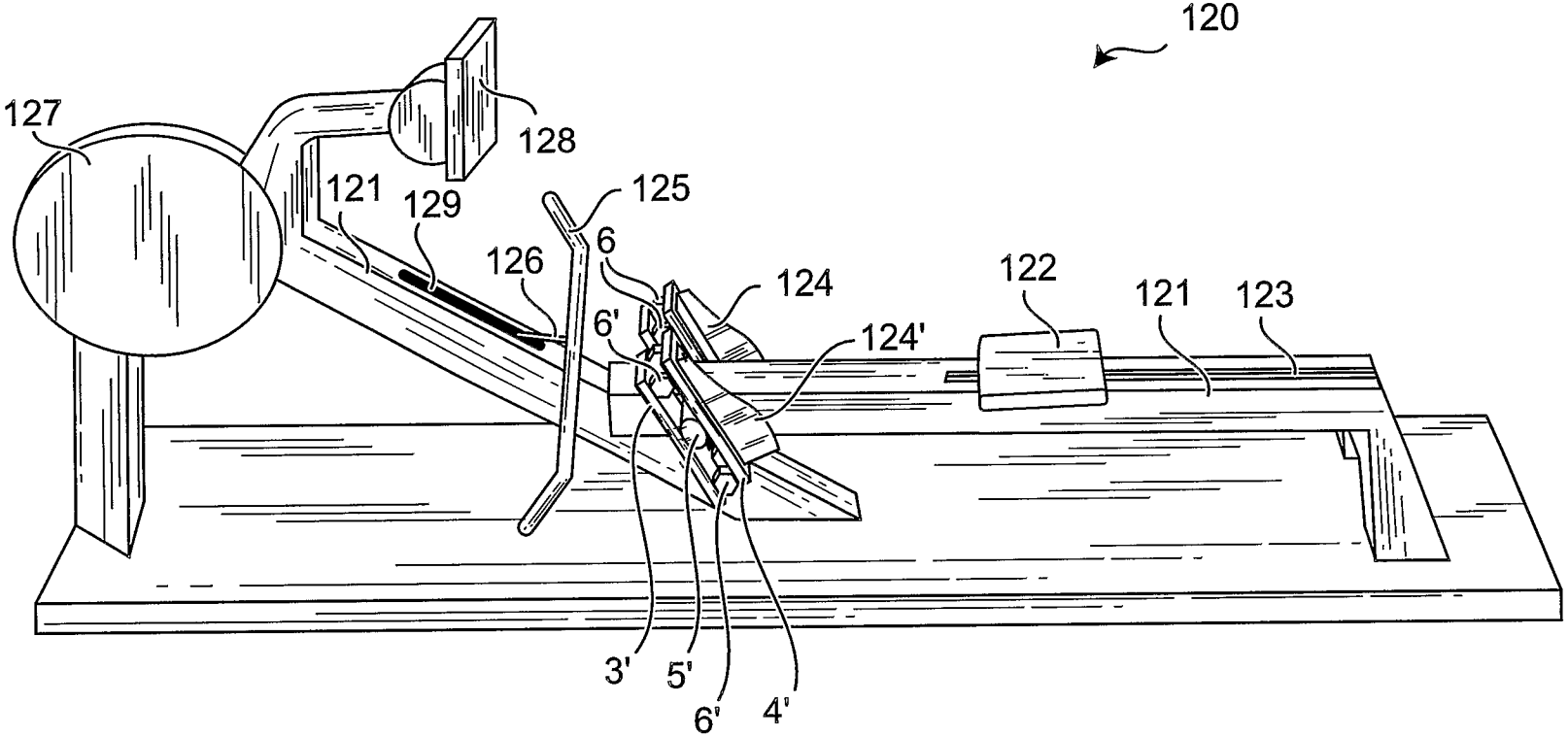
Figure 15:
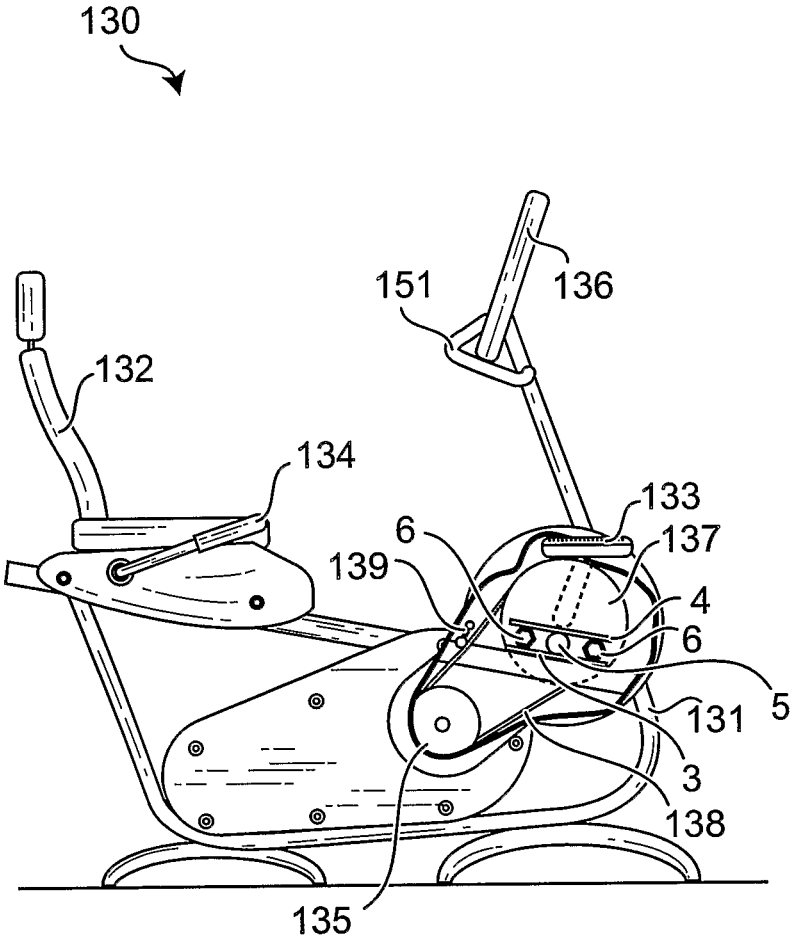
Figure 16:
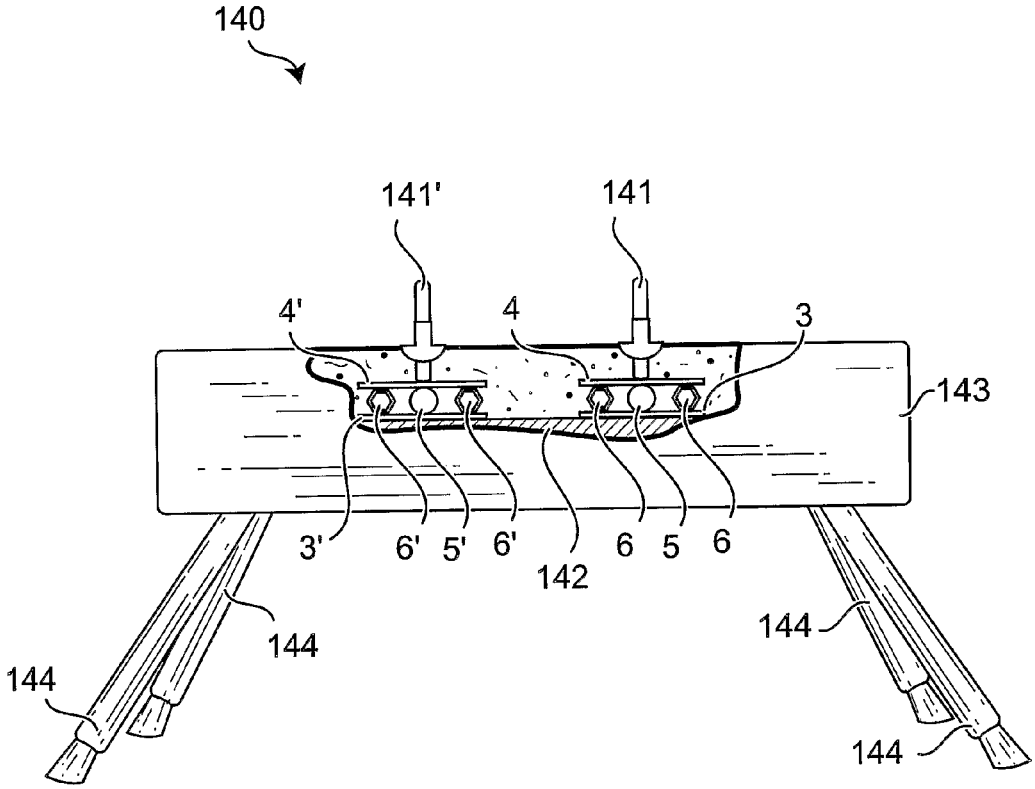

The present invention will now be described, by way of illustration and not by way of limitation, according to its preferred embodiments, by particularly referring to the Figures of the enclosed drawings, in which:

FIG. 1 schematically shows a first embodiment of the gym machine according to the invention;

FIG. 2 schematically shows a second embodiment of the gym machine according to the invention;

FIG. 3 shows a particular of the gym machine of FIG. 2;

FIG. 4 schematically shows a third embodiment of the gym machine according to the invention;

FIG. 5 schematically shows a fourth embodiment of the gym machine according to the invention;

FIG. 6 schematically shows a fifth embodiment of the gym machine according to the invention;

FIG. 7 schematically shows a sixth embodiment of the gym machine according to the invention;

FIG. 8 schematically shows a seventh embodiment of the gym machine according to the invention;

FIG. 9 schematically shows a eighth embodiment of the gym machine according to the invention;

FIG. 10 schematically shows a ninth embodiment of the gym equipment according to the invention;

FIG. 11 schematically shows a tenth embodiment of the gym machine according to the invention;

FIG. 12 schematically shows a eleventh embodiment of the gym machine according to the invention;

FIG. 13 schematically shows a twelfth embodiment of the gym machine according to the invention;

FIG. 14 schematically shows a thirteenth embodiment of the gym machine according to the invention;

FIG. 15 schematically shows a fourteenth embodiment of the gym machine according to the invention; e FIG. 16 schematically shows a fifteenth embodiment of the equipment according to the invention.

In the Figures, same reference numbers will be used for alike elements.

With reference to FIG. 1, it may be observed that a first embodiment of the gym machine according to the invention is a machine 1 for running, also known as "treadmill" or "tapis roulant", comprising a board around which a mat 2 is capable to rotate, on which a user may run. The board comprises a fixed lower platform 3 and an upper platform 4 to which a vibrating electric motor 5 is coupled, preferably having eccentric masses capable to produce a vibration of the upper platform 4. Three or more vibration-damping elements 6 are further located between the two platforms 3 and 4, which introduce a side component into the undulation of the upper platform 4 by opposing to the vibration produced by the motor 5. Preferably, such vibration-damping elements 6 comprise components of substantially hexagonal shape and are made in material comprising natural or synthetic rubber, e.g. neoprene. The motor 5 generates vibrations at a frequency preferably ranging from 20 to 55 Hz, and of amplitude preferably ranging from 2 to 5 mm. The user could also manually set the vibration frequency and/or the amplitude of the motor 5 through an interface 7.

Other embodiments of the machine 1 for running may comprise a plurality of electric motors 5, capable to generate synchronous or asynchronous vibrations, or a plurality of upper platforms 4, each one of which subjected to the vibrations of at least one corresponding electric motor 5.

In this way, the beneficial effect, that the physical exercise performed by running onto the mat 2 of the machine 1 of FIG.

1 has on the user's leg muscles, is improved by the vibration of the mat 2, due to the vibration of the underlying upper platform 4, which increases the stimulation of the user's leg muscles by causing periodical contractions thereof at a frequency equal to the vibration one of the motor 5.

Other embodiments of the machine may provide that the motor is driven by a controlling electronic device that adjusts the vibration frequency thereof. In particular, such controlling electronic device is capable to be connected to one or more muscular electrical activity sensors applicable to the user's muscles, capable to output a digital signal that is read by the controlling electronic device. By way of example and not bay way of limitation, such sensors may comprise medical electrodes 6, amplified in situ. The controlling electronic device processes data coming from said one or more sensors so as to determine, within an interval ranging from a lower limit lower limit frequency, preferably equal to 1 Hz, to an upper limit frequency, preferably equal to 1000 Hz, the optimal frequency of vibration of the upper platform 4 at which the muscle of which electric activity is sensed has the maximum response to the stimulation, consequently, setting the vibration frequency of the motor 5. In particular, the lower limit frequency and the upper limit frequency could be variable, depending on the specific fibres of the particular muscle to stimulate, and they may be set through the interface 7.

Preferably, the method for determining the optimal frequency may comprise the following steps:

a step of applying, in a conventional way, said one or more sensors to user's corresponding muscles;

repeating for a number N of times, with N preferably equal to eight, a step of acquiring data wherein the controlling electronic device:

activates the vibration of the motor 5 at constant frequency for a time Δt, with Δt preferably equal to 5 or 10 seconds, with progressively growing vibration frequency, from a repetition to the following one, ranging from the lower limit frequency to the upper limit frequency, processes, for each repetition, the average of the amplitude of the signals coming from each one of said one or more sensors and it stores it individually and/or it stores at least one function (e.g. a sum or an average, possibly weighted) of the averages coming from all the sensors, along with the value of the corresponding vibration frequency;

a step of determining the maximum electric response, wherein the controlling electronic device determines, among the stored ones, the average (or said at least one function of averages) having maximum value, consequently determining the optimal vibration frequency, at which the muscles of which the electric activity is sensed have the maximum response.

Preferably, frequencies of consecutive repetitions during the data acquisition have a constant difference from each other, more preferably (for six repetitions) equal to, respectively, 22.5 Hz, 25 Hz, 27.5 Hz, 30 Hz, 32.5 Hz and 35 Hz. However, it can be also provided a variable and increasing difference depending on the absolute value of the frequency of the preceding repetition Once determined the optimal frequency, the step of muscular stimulation may be started, during which the controlling electronic device activates vibration of the motor 5 at said optimal frequency for a time interval that is either predetermined or selectable by the user through the interface 7.

The step of determining the optimal frequency may be possibly periodically repeated, especially in the case when the time interval of the physical exercise is long.

Alternatively, the method for determining the optimal frequency may determine such frequency by successive approximations, comprising the following steps:

a step of applying, in a conventional way, said one or more sensors to user's corresponding muscles;

iterating by a number M of times, with M preferably equal to two, loops of a number $N_i$ of repetitions, where i indicates the i-th iteration, of steps of acquiring data wherein the controlling electronic device activates the vibration of the motor 5 at a constant frequency for a time Δt, with Δt preferably equal to 10 seconds, with progressively growing vibration frequency, from a repetition to the following one, ranging from a first lower frequency and a second upper frequency, the frequencies of consecutive repetitions having a constant difference $\Delta f_i$ from each other, where preferably, for the first iteration, the first lower frequency coincides with the lower limit frequency and/or the second upper frequency coincides with the upper limit frequency, the controlling electronic device calculating, for each repetition, the average of the amplitude of the signals coming from said one or more sensors and storing the same along with the value of the corresponding vibration frequency, the controlling electronic device determining for each iteration i, the average having maximum value and determining the corresponding best frequency, at each iteration i, next to the first one, the interval between the first lower frequency and the second upper frequency comprising the best frequency determined in the preceding iteration, preferably as intermediate frequency, at each iteration i, next to the first one, the constant difference $\Delta f_i$ between the frequencies of consecutive repetition being lower than the difference $\Delta f_{i-1}$ of the preceding iteration ($\Delta f_i < \Delta f_{i-1}$); and a step of determining the optimal frequency, at the end of the M-th iteration, in which the best frequency determined in the M-th iteration is stored as the optimal frequency, at which the muscles of which the electric activity has been sensed have the maximum response.

In other words, the just described method determines the optimal frequency by searching with a progressively improved resolution the vibration frequency at which the muscles of which the electric activity has been sensed have the maximum response.

The values of the optimal frequencies corresponding to various muscles of a same user could be possibly also stored on portable storage media, such as cards or magnetic and/or optical discs, through the interface 7, for being capable to be successively read by the same interface, avoiding further executions of the method for determining the optimal frequency.

The machine of FIG. 1 could provide at least one further motor, alternatively or in combination with the vibrating one, capable to generate an oscillating motion of the upper platform.

The vibrating board structure of FIG. 1 may be immediately applied to a different gym machine comprising one or more upper platforms onto which the mat slides.

With reference to FIG. 2 it may be observed that a second embodiment of the gym machine according to the invention is a machine 10 for simulating steps, also known as "step" machine. It substantially comprises a right board and a left board, each one of which comprises a lower platform, respectively 3 and 3', and an upper platform, respectively 4 and 4', to which a corresponding vibrating electric motor, respectively 5 and 5', is coupled, capable to produce a vibration of the respective upper platform. In each board, between the lower platform and the upper one, a pair vibration-damping elements, respectively 6 and 6', are located, each one of which preferably comprises a component 11 of hexagonal shape and a cylindrical support 12. As shown in greater detail in FIG. 3, lower right and left platforms 3 and 3' are constrained with each other through a pivoted lever 13, to which they are integrally coupled through a respective bar 14 and 14'. Moreover, the machine 10 comprises a pair of right guides 15 and a pair of left guides 15', along which the lower platforms 3 and 3' may slide.

The operation of the machine 10 is similar to that of the machine 1 of FIG. 1, wherein the beneficial effect of the physical exercise is improved by the vibration of the upper platforms 4 and 4' onto which the user's feet rest, since their vibration increases the stimulation of the user's leg muscles by causing periodical contractions thereof at a frequency equal to that of vibration of the motor 5.

With reference to FIG. 4 it may be observed that a third embodiment of the gym machine according to the invention is an elliptical machine 20, wherein the user places his/her feet onto a right board and a left board the movements of which are constrained with each other by means of two respective motion transmission levers 21 and 21', in turn connected to two respective cams coupled to each other and housed in a corresponding frame 22. The user may further cling with his/her hands to two front levers 23 and 23', the movement of which is also synchronised with that of the boards by means of a connection to the cams of the frame 22. Each one of the two boards comprises a lower platform (in FIG. 4 only the right one 3 is visible), and an upper platform (in FIG. 4 only the right one 4 is visible), to which a corresponding vibrating electric motor (in FIG. 4 only the right one 5 is visible) is coupled, capable to produce a vibration of the respective upper platform. In each board, a pair of vibration-damping elements (in FIG. 4 only the right ones 6 are visible) are located between the lower platform and the upper one.

Moreover, the machine 20 could further comprise two further vibrating electric motors (not shown), each one of which is integrally coupled to one of the two front levers 23 and 23', preferably in correspondence to the end held by the user, capable to produce a vibration of the respective front lever. In this case, the integral coupling between the vibrating motor, preferably with eccentric masses, and the respective front lever is sufficient to generate the vibration of the same lever, without the need for inserting vibration-damping elements which are instead preferably inserted for the boards.

The operation of the machine 20 is similar to that of the machine 1 of FIG. 1: the beneficial effect of the physical exercise is improved by the vibration of the upper platforms onto which the user's feet rest (and/or of the front levers held by the user's hands), since their vibration increases the stimulation of the user's leg muscles by causing periodical contractions thereof at a frequency equal to that of vibration of the motor.

The structure of the machines of FIGS. 2-4 may be applied to any machine provided with two boards for supporting user's feet.

With reference to FIG. 5 it may be observed that a fourth embodiment of the gym machine according to the invention is a machine 30 for exercising the muscles of the legs, also called sloping "leg press", wherein the user is sitting on a seat 31, provided with rollers 32 sliding onto a track guide arranged on a sloping frame 33, and he/she places his/her feet onto a base board orientated so as to allow the user to comfortably place his/her feet. Such board comprises a lower platform 3, integrally coupled to the frame 33, and an upper platform 4, to which a corresponding vibrating electric motor 5 is coupled, capable to produce a vibration of the upper platform 4. Two vibration-damping elements 6 are located between the lower platform 3 and the upper one 4.

The operation of the machine 30 is similar to that of the machines of the previous Figures, wherein the beneficial effect of the physical exercise is improved by the vibration of the upper platform 4 onto which the feet rest of the user, who performs the exercise by repeatedly pushing the base board with his/her legs, making the seat 31 slide upwards, while his/her hands hold the handles of two levers 34 and 34' which are integral with the seat 31. The vibration of the upper platform 4 of the base board increases the stimulation of the user's leg muscles by causing periodical contractions thereof at a frequency equal to that of vibration of the motor 5.

Alternatively, the base board could be subdivided into two right and left portions, onto each one of which a respective user's foot rests, each provided with a lower platform, a motor, and an upper platform caused to vibrate by the motor.

Optionally, two further vibrating electric motors (not shown) could be coupled also to the two levers 34 and 34', preferably in correspondence to the end held by the user, capable to produce a vibration of the respective lever 34 or 34'.

The structure of the machine of FIG. 5 may be applied to any similar machine, comprising one or two boards, such as for instance a "leg press", either sloping or not, wherein the seat is integrally coupled to the frame, while the base board may slide along the frame, the user pushing with his/her legs the board, the upper platform of which vibrates so as to make it move away, the board being capable to be connected in a conventional way to one or more selectable weights for adjusting its load.

The structure of the machine of FIG. 5 may be also applied to any machine provided with board for supporting feet of a user. By way of example, but not by way of limitation, FIG. 6 shows a fifth embodiment of the gym machine according to the invention: a machine 40 for exercising calf muscles, also called "calf machine". The machine 40 has a conventional frame 41 provided with a base board, onto which the user stands, and with two loaded levers 42 and 42', preferably provided in correspondence to the ends resting on the user's shoulders with proper stuffings 43 and 43'; in particular, the loaded levers 42 and 42' are connected in a conventional way to one or more selectable, weights for adjusting their loads. The base board comprises a lower platform 3, integrally coupled to the frame 41, and an upper platform 4, to which a corresponding vibrating electric motor 5 is coupled, capable to produce a vibration of the upper platform 4. Four vibration-damping elements 6 are located between the lower platform 3 and the upper one 4.

The operation of the machine 40 is similar to that of the machines of the previous Figures, wherein the beneficial effect of the physical exercise, during which the user raises the load of the levers 42 and 42' by going on tip-toe, is improved by the vibration of the upper platform 4 onto which the user's feet rest. The vibration of the base board upper platform 4 increases the stimulation of the user's leg muscles causing by causing periodical contractions thereof at a frequency equal to that of vibration of the motor 5.

Still, the base board could be subdivided into two right and left portions, each provided with a motor capable to cause an upper platform to vibrate.

The structure of the machine of FIG. 6 may be applied to any similar machine, e.g. a calf machine wherein the user is sitting and the load is applied onto the upper part of his/her legs, in particular shortly beyond the knee.

With reference to FIG. 7 it may be observed that a sixth embodiment of the gym machine according to the invention is a machine 50 for exercising pectoral and dorsal muscles, wherein the user sits on a seat 51, preferably of conventionally adjustable height, provided with a back 52, integrally coupled to a frame 53, and he/she places his/her feet onto a base rod 54 such to allow the user to comfortably place his/her feet The machine 50 further comprises a pair of right and left side levers, 55 and 55', each one of which is integrally coupled to a respective rotary disc, 56 and 56', provided with a vertical axis rotatably coupled to the frame 53. Each one of the two side levers 55 and 55' is provided with a stuffed handle 57 and 57' on which the user exert a push with his/her arms for moving the same levers nearer, making them rotate towards the front part of the back 52. A vibrating electric motor 5 and 5' is integrally coupled to each one of the side levers 55 and 55', for instance within the stuffing 57 or 57', capable to produce a vibration of the corresponding lever 55 or 55'. The side levers 55 and 55' are loaded by means of a conventional connection, e.g. a pulley one, to one or more selectable weights 58 for adjusting its load. In particular, the vibration-damping elements, in FIG. 7 indicated to with reference numbers 6 and 6', may be also not present.

The operation of the machine 50 is similar to that of the machines of the previous Figures, wherein the beneficial effect of the physical exercise is improved by the vibration of the levers 55 and 55' onto which the arms rest of the user, who exercises his/her pectoral and dorsal muscles for pushing them and making them frontally rotate. The vibration of the levers 55 and 55' increases the stimulation of the user's pectoral and dorsal muscles by causing periodical contractions thereof at a frequency equal to that of vibration of the motors 5 and 5'.

The structure of the machine of FIG. 7 may be applied to any similar machine comprising side levers on which the user exerts a push for making them rotate around a vertical axis, e.g. machines for exercising adductor and abductor muscles, wherein the side levers are pushed by the legs of the user, who is sitting, for making them rotate, respectively, inwards and outwards with respect to the machine.

With reference to FIG. 8 it may be observed that a seventh embodiment of the gym machine according to the invention is a machine 60 for exercising triceps, also called "triceps press", wherein the user sits on a seat 61, preferably of conventionally adjustable height, provided with a back 62, integrally coupled to a frame 63, and he/she places his/her feet on a base rod 64 such to allow the user to comfortably place his/her feet. The machine 60 further comprises a pair of right and left side levers, 65 and 65', integrally coupled to two respective rotary discs (only the left one 66' of which is visible in the Figure), coupled to each other by means of a single horizontal axis rotatably coupled to frame 63. The user exerts a push upwards with his/her arms on the two side levers 65 and 65', by extending his/her arms for raising the same levers, making them rotate around the disc axis. The side levers 65 and 65' are integrally coupled to each other by means of a connection rod 67, in back of the back 62, to which a vibrating electric motor 5 is coupled, capable to produce a vibration of the levers 65 and 65'. The side levers 65 and 65' are loaded by means of a conventional connection, e.g. a pulley one, to one or more selectable weights 68 for adjusting their load. In particular, the vibration-damping elements, indicated in FIG. 8 with the reference number 6, may be also not present.

The operation of the machine 60 is similar to that of the machines of the previous Figures, wherein the beneficial effect of the physical exercise is improved by the vibration of the levers 65 and 65' through which the user exerts his/her arm triceps muscles for pushing them upwards. The vibration of the levers 65 and 65' increases the stimulation of the user's triceps muscles by causing periodical contractions thereof at a frequency equal to that of vibration of the motor 5.

The structure of the machine of FIG. 8 may be applied to any similar machine comprising side levers on which the user exerts a push (upwards, or even downwards) for making them rotate around a horizontal axis, e.g. a machine similar to that of FIG. 8 wherein the levers are not coupled to each other and wherein the rotary discs do not share the same axis, or the machines for exercising the trunk muscles (such as for instance the "chest presses") and the machines for exercising the shoulder muscles (such as for instance the "shoulder presses") wherein the user makes similar side levers rotate by pushing them outwards or upwards.

With reference to FIG. 9 it may be observed that an eighth embodiment of the gym machine according to the invention is a machine 70 for exercising the dorsal and biceps brachii muscles, also called machine for tractions at the bar or "lat machine", wherein the user sits on a seat 71 integrally coupled to a frame 72, provided with an element 73 with two stuffings 74 and 74' for blocking the legs, preferably of conventionally adjustable height. The machine 70 further comprises an upper bar 75 connected, in a conventional way (e.g. a pulley one) through a cable 76, to one or more selectable weights 77 which adjust its load. A vibrating electric motor 5, embodied within a container 78, is coupled to the bar 75, that is clung with his/her hands by the user who pulls it downwards either in front or in back of his/her head, which motor is capable to produce a vibration of the bar 75. In particular, the vibration-damping elements, indicated in FIG. 9 with the reference number 6, may be also not present.

The operation of the machine 70 is similar to that of the machines of the previous Figures, wherein the beneficial effect of the physical exercise is improved by the vibration of the bar 75, that increases the stimulation of the muscles, employed by the user for lowering the same bar, by causing periodical contractions thereof at a frequency equal to that of vibration of the motor 5. In particular, an interface electronic apparatus 79 is visible in the Figure, connected via wire 69 to the motor 5, which allows the user to activate the motor and to set its operation mode.

The structure of the machine of FIG. 9 may be applied to any similar machine comprising a bar or any element provided with handles (for at least one limb of the user) connected through a cable to a load, on which user exerts a traction push. By way of example, e.g. a machine similar to that of FIG. 9 wherein the handle and levers are not coupled to each other and wherein the rotary discs do not share the same axis, or the machines for exercising the trunk muscles (such as for instance the "chest presses") and the machines for exercising the shoulder muscles (such as for instance the "shoulder presses") wherein the user makes similar side levers rotate by pushing them outwards or upwards.

In particular, with reference to FIG. 10, it may be observed that a ninth embodiment of a gym equipment according to the invention is a barbell 80, that in the Figure is shown as resting on supports 81 and 81' of the two vertical rods 82 and 82' of a bench 83. The barbell 80 is capable to conventionally removably receive at its ends weights 84 in order to be suitably loaded. A vibrating electric motor 5, embodied within a container 85, is coupled to the barbell 80, that is clung with his/her hands by the user who, getting in an upright, sitting, or lying down position, repeatedly raises it upwards, which motor is capable to produce a vibration of the barbell 80. In particular, the vibration-damping elements, only one of which, indicated with the reference number 6, is visible in FIG. 10, may be also not present. As for the machines of the previous Figures, the beneficial effect of the physical exercise is improved by the vibration of the barbell 80, that increases the stimulation of the muscles employed by the user, by causing periodical contractions thereof at a frequency equal to that of vibration of the motor 5. In particular, the container 85 could be retrofit coupled also to already existing barbells, by providing it with mechanical means of coupling to the barbells, such as for instance brackets which removably couple to these. The structure of the barbell 80 of FIG. 10 may be applied to dumbbells, bars, rods and to any machine comprising a barbell, one or more dumbbells, a rod or a bar loadable with weights.

With reference to FIG. 11, it may be observed that a tenth embodiment of the gym machine according to the invention is a machine 90 for exercising the leg muscles, also called "leg extension" machine, wherein the user sits on a seat 91 provided with a back 92, integrally coupled to a frame 93. The machine 90 further comprises a front lever 94 (represented in the Figure as substantially in a rest position) the upper end 95 of which is rotatably coupled to the seat 91 so as to be capable to rotate upwards. In particular, an element 99, preferably of conventionally adjustable height, is coupled to the front lever 94, which element is provided with a right and left stuffings 96 and 96', on which the user exerts a push by means of his/her feet for raising the lever 94. A vibrating electric motor 5, housed within a container 97, is coupled to the front lever 94, which motor is capable to produce a vibration of the lever 94, that is preferably loaded by means of a conventional connection, e.g. a pulley one, to one or more selectable weights (not shown in Figure) for adjusting its load. In particular, the vibration-damping elements, indicated in FIG. 11 with the reference number 6, may be also not present.

The operation of the machine 90 is similar to that of the machines of the previous Figures, wherein the beneficial effect of the physical exercise is improved by the vibration of the front lever 94 through which the user exerts the leg muscles for making it rotate upwards. The vibration of the front lever 94 increases the stimulation of the user's leg muscles by causing periodical contractions thereof at a frequency equal to that of vibration of the motor 5.

The structure of the machine of FIG. 11 may be applied to any similar machine comprising a lever that may be activated by the user's limbs, preferably the lower ones, for making it rotate around a horizontal axis; for instance a machine similar to that of FIG. 11 in which the front lever is sideway, instead of midway, coupled to the seat 91 and the element provided with the stuffings 96 and 96' is substantially a horizontal rod an end of which is coupled to the front lever (although in this case the vibration is not uniformly distributed on both the legs); or still a machine similar to that of FIG. 11 in which there are two midway front levers, which may be removably coupled so as to be capable to be moved also independently from one another; or furthermore a machine similar to that of FIG. 11 in which the user, instead of sitting, assumes an upright position.

A further example is shown in FIG. 12, wherein it may be observed an eleventh embodiment 100 of the gym machine according to the invention, still for exercising the leg muscles, also called machine for contracting legs or "leg curl" machine, wherein the user lies prone on a bench 101, integrally coupled to a frame 102. The machine 100 further comprises a front lever 103 (represented in the Figure substantially in a rest position) the upper end 104 of which is rotatably coupled to the bench 101 so as to be capable to rotate upwards. In particular, right and left stuffings 105 and 105', integral to each other and preferably of conventionally adjustable height, are coupled to the front lever 103, on which stuffings the user exerts a push by means of the heels for raising the lever 103 making it rotate upwards. A vibrating electric motor 5, housed within a container 106, is coupled to the front lever 103, which motor is capable to produce a vibration of the lever 103, that is preferably loaded by means of a conventional connection, e.g. a pulley one, to one or more selectable weights (not shown in the Figure) for adjusting its load. In particular, the vibration-damping elements, indicated in FIG. 12 with the reference number 6, may be also not present. Also in this case, the structure of the machine of FIG. 12 may be applied to the case wherein the user, instead of lying down, assumes an upright position (e.g. in the so-called "standing gluteus" machine).

With reference to FIG. 13, it may be observed that a twelfth embodiment of the gym machine according to the invention is a cable traction machine 110 for exercising the muscles of the limbs, in particular of the arms. The machine 110 comprises a frame 111 subdivided into two sections, a right one and a left one, each one of which comprises a cable, respectively 112 and 112', connected to one or more selectable weights, respectively 118 and 118', for adjusting its load. The cable 112 or 112' may be pulled, through conventional elements such as pulleys, respectively 113 and 113', by a user clinging to respective handle, respectively 114 and 114', with a hand. In particular, the handle may be any one, and it may be also replaced with a rod or any element provided with handles, in order to allow the user to exercise the selected muscles. The machine further comprises a horizontal rod 115, coupled to the frame 111, preferably of conventionally adjustable height, provided with a cam, respectively 116 and 116', for each cable 112 and 112', that is activated by an electric motor 117 for creating a unbalance of positioning of the cable, 112 and 112', making the respective handle, respectively 114 and 114', vibrate. An interface electronic apparatus 119, connected via cable 109 to the motor 117, allows the user to activate the motor and to set its operation modes.

The operation of the machine 110 is similar to that of the machines of the previous Figures, wherein the beneficial effect of the physical exercise is improved by the vibration of the handles 114 and 114', through which the user exercises the arm muscles for pulling the cables 112 and 112', since this vibration increases the stimulation of the muscles by causing periodical contractions thereof at a frequency equal to that introduced by the cams 116 and 116'.

The structure of the machine of FIG. 13 may be applied to any similar machine comprising at least one loaded cable pullable by means of at least one operation element. For instance the structure is also applicable to a machine comprising a system of lower cables operatable by means of rings in which a user's foot goes. Furthermore, the machine of FIG. 13 may further be provided with a base board that may be rendered vibrating by means of a system similar to what already previously described, for instance in reference to the machine 40 of FIG. 6.

Moreover, a rod similar to the one 115 of FIG. 13, provided with one or more cams 116 operated by at least one electric motor 117, could be also retrofit coupled to the frame 111 of already existing cable traction machines.

With reference to FIG. 14, it may be observed that a thirteenth embodiment of the gym machine according to the invention is a machine 120 for simulating rowing, also called "rower". The machine 120 comprises a frame 121 on which a seat 122, onto which the user is sitting, is capable to slide along a guide 123, and a right board 124 and a left board 124', onto which the user's feet rest. Each board (only the left board 124' is shown in detail in the Figure) comprises a lower platform, 3', coupled to the frame 121, and an upper platform, 4', to which a corresponding vibrating electric motor, 5', is coupled, that is capable to produce a vibration of the respective upper platform, 4'. In each board, four vibration-damping elements, 6', are located between the lower platform and the upper one. The machine 120 further comprises a rod 125 capable to pull a cable 126, conventionally loaded by means of a flywheel housed in a suitable container 127 coupled to the frame 121. An interface electronic apparatus 128, connected to the vibrating electric motors, allows the user to activate and to set the operation mode of the same motors. The user trains pulling the rod 125 by exerting a push with his/her feet onto the boards 124 and 124'.

Possibly, within the frame 121, in correspondence to the aperture 129 from which the cable 126 comes out, the machine 120 may be provided with a cam, operated by a corresponding electric motor, for creating an unbalance of positioning of the cable 126, thus making the rod 125 vibrate. In such case, the user could also activate and set the operation mode of the motor operating the cam by means of the interface apparatus 128.

The operation of the machine 120 is similar to that of the machines of the previous Figures, wherein the beneficial effect of the physical exercise is improved by the vibration of the boards 124 and 124' and, possibly, of the rod 125, by interacting with which the user trains pulling the cable 126, since such vibration increases the stimulation of the muscles by causing periodical contractions thereof at a frequency equal to that introduced by the vibrating motors of the boards and possibly of the cam of the cable 126.

The structure of the machine of FIG. 14 may be applied to any similar machine, e.g. to a similar machine comprising, instead of two boards, a single board where the user's feet rest, or to a similar machine in which the frame is separated into two sections, one comprising the vibrating boards and the possible cable cam, and one comprising the seat, in order to prevent the motor vibrations from being transmitted to the seat.

With reference to FIG. 15, it may be observed that a fourteenth embodiment of the gym machine according to the invention is an exercise cycle 130, that comprises a frame 131 to which a seat 132 (possibly replaced with any saddle) is coupled, onto which seat a user is sitting, and a right pedal 133 and a left pedal (not shown), integrally coupled to the shaft (not shown) of a rotary disc 137, onto which pedals the user's feet rest for allowing him/her to pedal. In particular, the seat 132 may be provided with a right lever 134 and a left lever (not shown) that the user may grasp for clinging. A flywheel un flywheel 135 connected to the rotary disc 137 by means of a conventional driveline, preferably a belt drive 138, opposes pedals rotation. The resistance of the flywheel 135 is preferably selectable by the user through an interface electronic apparatus 136. The machine further comprises a lower platform 3, coupled to the frame 131, and an upper platform 4 to which a vibrating electric motor 5 is coupled, capable to produce a vibration of the upper platform 4; two vibration-damping elements 6 are preferably located between the lower platform and the upper one. The shaft of the rotary disc 137 is coupled to the upper platform 4, whereby the vibrations of the latter cause corresponding vibrations of the pedals, while at least one tightener element 139 compensates the vibrations of the disc 137 always keeping the drive belt tight. The user may preferably activate and set the operation mode of the motor 5 always by means of the interface apparatus 136.

Possibly, the levers 134 and 134' of the seat and a handlebar 151, to which the user may cling, may be also provided with corresponding vibrating electric motors capable to make respective lever or handlebar vibrate.

The operation of the machine 130 is similar to that of the machines of the previous Figures, wherein the beneficial effect of the physical exercise is improved by the vibration of the pedals (and, possibly, of the levers of the seat and/or of the handlebar 151), since such vibration increases the stimulation of the muscles employed during training by causing periodical contractions thereof at a frequency equal to that introduced by the motor 5.

The structure of the machine of FIG. 15 may be applied to any similar machine, e.g. a similar machine comprising, instead of one single upper platform, two, right and left, upper platforms onto which the right and left portions of the shaft of the rotary disc 137 rest.

With reference to FIG. 16, it may be observed that a fifteenth embodiment of the gym equipment according to the invention is a pommel horse 140, comprising two handles or pommels 141 and 141'. The pommel horse 140 comprises a frame 142, covered with a stuffing 143, provided with four legs 144. The pommel horse 140 internally comprises, for each pommel 141 and 141', a lower platform, respectively 3 and 3', coupled to the 142, and an upper platform, respectively 4 and 4', to which a corresponding vibrating electric motor, respectively 5 and 5', is coupled, capable to produce a vibration of the respective upper platform. A pair of vibration-damping elements, respectively 6 and 6', preferably of hexagonal shape, is located between each lower platform 3 and 3' and the respective upper platform 4 and 4'.

The operation of the machine 140 is similar to that of the machines of the previous Figures, wherein the beneficial effect of the physical exercise is improved by the vibration of the pommels 141 and 141' which are clung by the user during the gym exercise, which vibration is caused by the corresponding upper platforms 4 and 4', since such vibration increases the stimulation of the user's muscles by causing periodical contractions thereof at a frequency equal to that of vibration of the motors 5 and 5'.

The structure of the machine of FIG. 16 may be applied to any similar machine, i.e. comprising one or more handles which may be clung by the user.

Similarly to the machine 1 of FIG. 1, also the machines 10, 20, 30, 40, 50, 60, 70, 90, 100, 110, 120, and 130, of FIGS. 2-3, 4, 5, 6, 7, 8, 9, 11, 12, 13, 14, and 15, and the equipments 80 and 140 of FIGS. 10 and 16 may optionally comprise a corresponding controlling electronic device driving the respective vibrating motors, adjusting their vibration frequency. In particular, the machines could further determine the optimal frequency of vibration of the vibrating motors according to the method described with reference to the machine 1 of FIG. 1, by means of the aid of one or more muscular electrical activity sensors.

Obviously, the vibrating means illustrated with reference to the machines 10, 20, 30, 40, 50, 60, 70, 90, 100, 110, and 120, of FIGS. 2-3, 4, 5, 6, 7, 8, 9, 11, 12, 13, 14, as well as the motor applied to the barbell 80 of FIG. 10, may be provided with conventional mechanical means (e.g. brackets, nuts, bolts, screws, or the like) in order to be retrofit applicable to already existing conventional machines.

Obviously, for all the previously described machines, electric wiring must be suitably insulated in order to ensure the user's safety and arranged so as not to obstruct the execution of the gym exercises.

The preferred embodiments have been above described and some modifications of this invention have been suggested, but it should be understood that those skilled in the art can make other variations and changes, without so departing from the related scope of protection, as defined by the following claims.

The invention claimed is:

1. An apparatus for physical exercises or exercise, comprising at least one element, capable to interact with a user during the execution of a physical exercises or exercise, wherein the apparatus comprises vibrating means capable to produce at least one mechanical vibration of said at least one element, the vibrating means includes at least one vibrating electric motor coupled to said at least one element and wherein said at least one element comprises at least one first platform to which said at least one vibrating electric motor is coupled, further wherein the apparatus is a machine for exercising leg muscles comprising a seat, and mechanical means capable to allow said at least one first platform and the seat to reciprocally move with respect to one another, so that said mechanical means is elastically opposed to reciprocal movement of said at least one first platform and the seat, which move apart from each other.

2. An apparatus according to claim 1, wherein said at least one mechanical vibration occurs at a frequency included within an interval ranging from a lower limit frequency, to an upper limit frequency.

3. An apparatus according to claim 1, wherein said at least one vibrating electric motor (5) is an eccentric mass motor.

4. An apparatus according to claim 1, wherein said at least one vibrating electric motor (5) is capable to produce at least one vibration of amplitude ranging from 1 to 10 mm.

5. An apparatus according to claim 4, wherein said at least one vibrating electric motor (5) is capable to produce at least one vibration of amplitude ranging from 2 to 5 mm.

6. An apparatus according to claim 1, wherein said at least one element further comprises at least one handle integrally coupled to said at least one first platform.

7. An apparatus according to claim 1, wherein it further comprises at least one second platform and in that wherein a vibration-damping means is located between said at least one second platform and said at least one first platform capable to oppose the vibration produced by said vibrating means.

8. An apparatus according to claim 1, wherein said at least one element comprises at least one rod to which said at least one vibrating electric motor is coupled.

9. An apparatus according to claim 8, wherein it further comprises vibration-damping means capable to oppose the vibration produced by said vibrating means.

10. An apparatus according to claim 7, wherein said vibration-damping means comprises one or more components in natural or synthetic rubber.

11. An apparatus according to claim 10, wherein at least one of said one or more components has substantially hexagonal shape.

12. An apparatus according to claim 1, wherein said at least one element comprises at least one cable, provided with at least one component capable to be clung by the user, and said vibrating means comprises at least one cam device into which said at least one cable is capable to slide.

13. An apparatus according to claim 12, wherein said at least one cam device is capable to be operated by an electric motor.

14. An apparatus according to claim 12, wherein said at least one component, capable to be clung by the user, comprises a handle and/or a rod.

15. An apparatus according to claim 1, wherein said at least one element is capable to be connected to one or more selectable weights for adjusting its load.

16. An apparatus according to claim 1 wherein it comprises two rods operating as side levers for supporting the user.

17. An apparatus according to claim 1, wherein it further comprises interface electronic means capable to set the operation of said vibrating means.

18. An apparatus according to claim 1, wherein it comprises controlling electronic means capable to control the operation of said vibrating means, said controlling electronic means being capable to be connected to one or more muscular electrical activity sensors, each applied to a corresponding user's muscle, said controlling electronic means managing and controlling said vibrating means, by processing data coming from the sensors so as to determine, within an interval ranging from a lower limit frequency to an upper limit frequency, an optimal frequency of said at least one mechanical vibration in correspondence of which the sum of the amplitudes of the signals given to the sensors by the corresponding user's muscles is maximum, said controlling electronic means setting the operation of said vibrating means so as to produce said at least one mechanical vibration at the determined optimal frequency.

19. An apparatus according to claim 18, wherein the lower limit frequency is equal to 1 Hz.

20. An apparatus according to claim 18, wherein the upper limit frequency is equal to 1000 Hz.

21. An apparatus according to claim 18, wherein at least one of said one or more muscular electrical activity sensors comprises medical electrodes, amplified in situ, an insulating amplifier and a signal converter outputting a digital signal that is read by said controlling electronic means.

22. An apparatus according to claim 18, wherein said controlling electronic means performs a method for determining the optimal frequency comprising the following steps:

a step of applying said one or more sensors to corresponding muscles;

repeating for a number N of times a step of acquiring data wherein said controlling electronic means activates said vibrating means so as to produce said at least one vibration at constant frequency for a time $\Delta t$ with progressively growing frequency, from a repetition to the following one, ranging from the lower limit frequency to the upper limit frequency, it processes, for each repetition, the average of the amplitude of the signals coming from the sensors, and it stores it into a storage unit along with the value of the corresponding vibration frequency; and a step of determining the maximum sum of the averages of the amplitude of the signals sensed by the sensors, wherein said controlling electronic means determines, among the stored ones, the sum of the averages at the same frequency having maximum value, determining the optimal frequency.

23. An apparatus according to claim 22, wherein N is equal to eight.

24. An apparatus according to claim 22, wherein $\Delta t$ is equal to 5 seconds.

25. An apparatus according to claim 22, wherein $\Delta t$ is equal to 10 seconds.

26. An apparatus according to claim 22, wherein the frequencies of consecutive repetitions have a constant difference from each other.

27. An apparatus according to claim 22, wherein the frequencies of consecutive repetitions have a variable and increasing difference depending on the absolute value of the frequency of the preceding repetition.

28. An apparatus according to claim 18, wherein said controlling electronic means performs a method for determining the optimal frequency comprising the following steps:

a step of applying said one or more sensors to corresponding muscles;

iterating by a number M of times loops of a number $N_i$ of repetitions, where i indicates the i-th iteration, of steps of acquiring data wherein said controlling electronic means activates said vibrating means so as to produce said at least one vibration at constant frequency for a time Δt with progressively growing frequency, from a repetition to the following one, ranging from a first lower frequency and a second upper frequency, the frequencies of consecutive repetitions having a constant difference $\Delta f_i$ from each other, said controlling electronic means calculating, for each repetition, the average of the amplitude of the signals coming from said one or more sensors and storing the same in a storage unit along with the value of the corresponding frequency, said controlling electronic means determining for each iteration i, the maximum sum of the averages of the amplitude of the sensed signals and determining the corresponding best frequency, at each iteration i, next to the first one, the interval between the first lower frequency and the second upper frequency comprising the best frequency determined in the preceding iteration, at each iteration i, next to the first one, the constant difference $\Delta f_i$ between the frequencies of consecutive repetition being lower than the difference $\Delta f_{i-1}$ of the preceding iteration ($\Delta f_i < \Delta f_{i-1}$); and a step of determining the optimal frequency, at the end of the M-th iteration, in which the best frequency determined in the M-th iteration is stored as the optimal frequency.

29. An apparatus according to claim 28, wherein M is equal to two.

30. An apparatus according to claim 28, wherein Δt is equal to 5 seconds.

31. An apparatus according to claim 28, wherein Δt is equal to 10 seconds.

32. An apparatus according to claim 28, wherein, for the first iteration, the first lower frequency coincides with the lower limit frequency and/or the second upper frequency coincides with the upper limit frequency.

33. An apparatus according to claim 28, wherein at each iteration, next to the first one, the interval between the first lower frequency and the second upper frequency comprises the best frequency determined in the preceding iteration as intermediate frequency.

34. An apparatus according to claim 2, wherein the lower limit frequency is equal to 20 Hz and the upper limit frequency is equal to 55 Hz.

35. An apparatus according to claim 10, wherein said natural or synthetic rubber is neoprene.

* * * * *